United States Patent [19]

Vitale et al.

[11] Patent Number: 4,567,726

[45] Date of Patent: Feb. 4, 1986

[54] EXTERNALLY EXCITED RESONANT FREE PISTON STIRLING ENGINE THERMAL AMPLIFIER SYSTEM AND METHOD OF OPERATION AND CONTROL THEREFOR

[75] Inventors: Nicholas G. Vitale; Manmohan Dhar, both of Schenectady, N.Y.

[73] Assignee: Mechanical Technology Incorporated, Latham, N.Y.

[21] Appl. No.: 528,896

[22] Filed: Sep. 2, 1983

[51] Int. Cl.[4] ..... F02G 1/06

[52] U.S. Cl. ..... 60/520; 60/518; 62/6

[58] Field of Search ..... 60/517, 520, 518; 62/6

[56] References Cited

U.S. PATENT DOCUMENTS

| | | | |
|---|---|---|---|
| 4,389,849 | 6/1983 | Gasser et al. | 62/6 |
| 4,397,155 | 8/1983 | Davey | 60/520 X |
| 4,434,617 | 3/1984 | Walsh | 60/518 X |
| 4,489,554 | 12/1984 | Otters | 60/520 |

*Primary Examiner*—Stephen F. Husar

*Attorney, Agent, or Firm*—Joseph V. Claeys; Charles W. Helzer

[57] ABSTRACT

An externally excited resonant free piston Stirling engine thermal amplifier system which is over damped at all load levels and will not freely oscillate and wherein the displacer/piston system of the Stirling engine is externally driven by a separate drive motor. The system includes means for sensing at least one preselected operating parameter of the Stirling engine thermal amplifier and/or the load driven by the Stirling engine thermal amplifier and deriving feedback signals indicative of such operating parameters. The system further includes feedback means responsive to the operating parameter sensed signals and operative to develop control signals for variably controlling the drive motor to thereby precisely, variably and stably control the operation of the Stirling engine thermal amplifier system.

52 Claims, 13 Drawing Figures

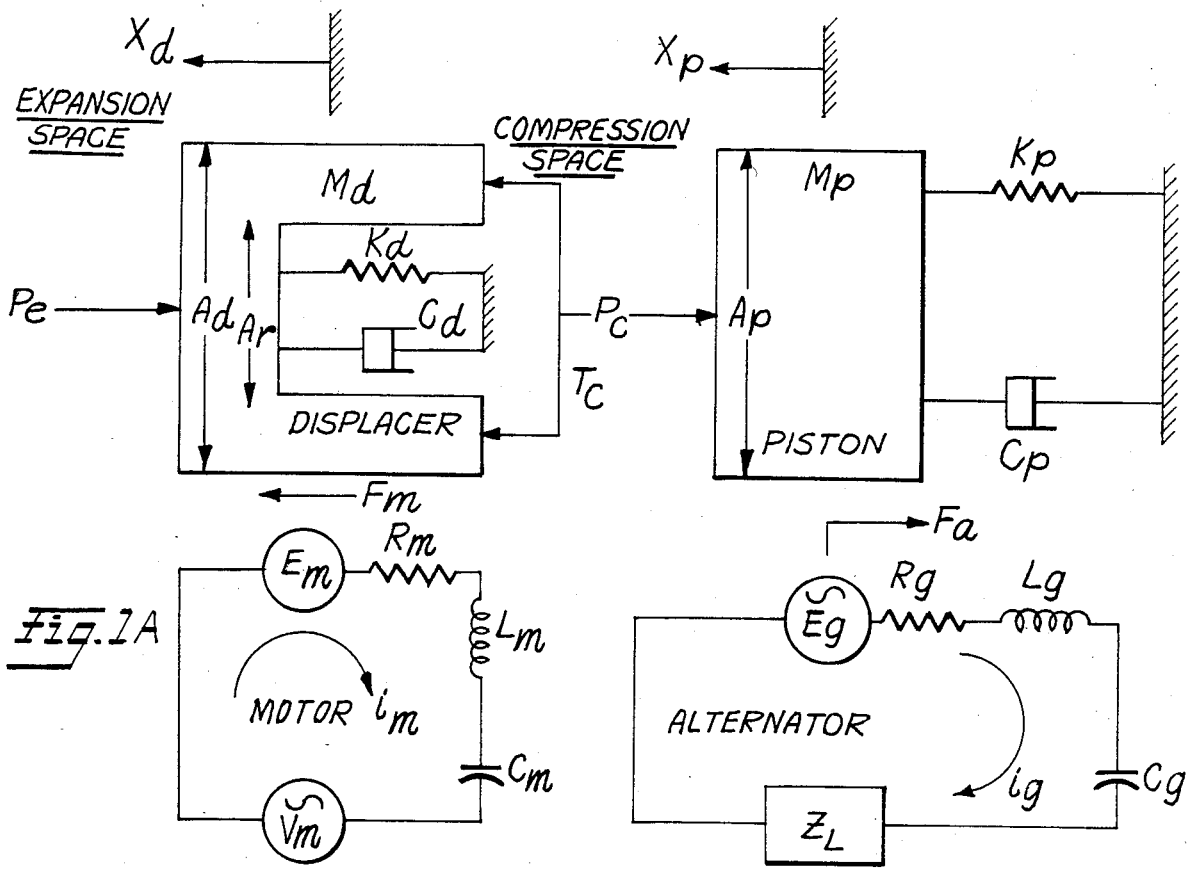
Fig. 1A
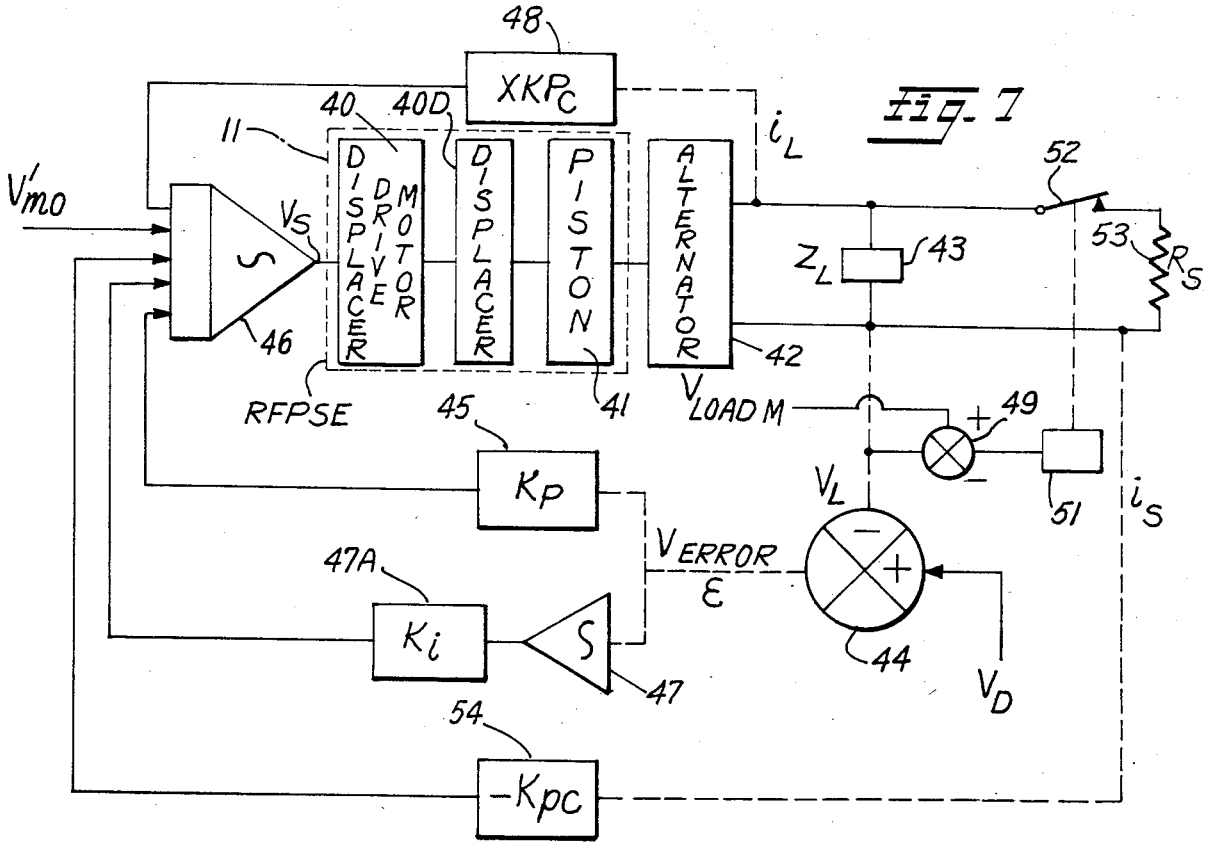

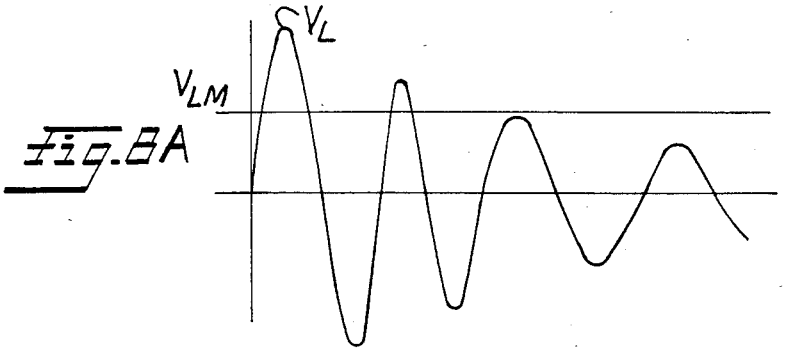
fig. 8A
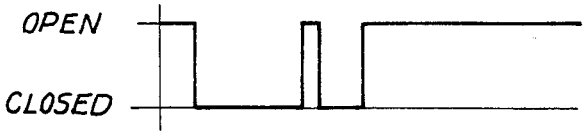
fig. 8B
fig. 9
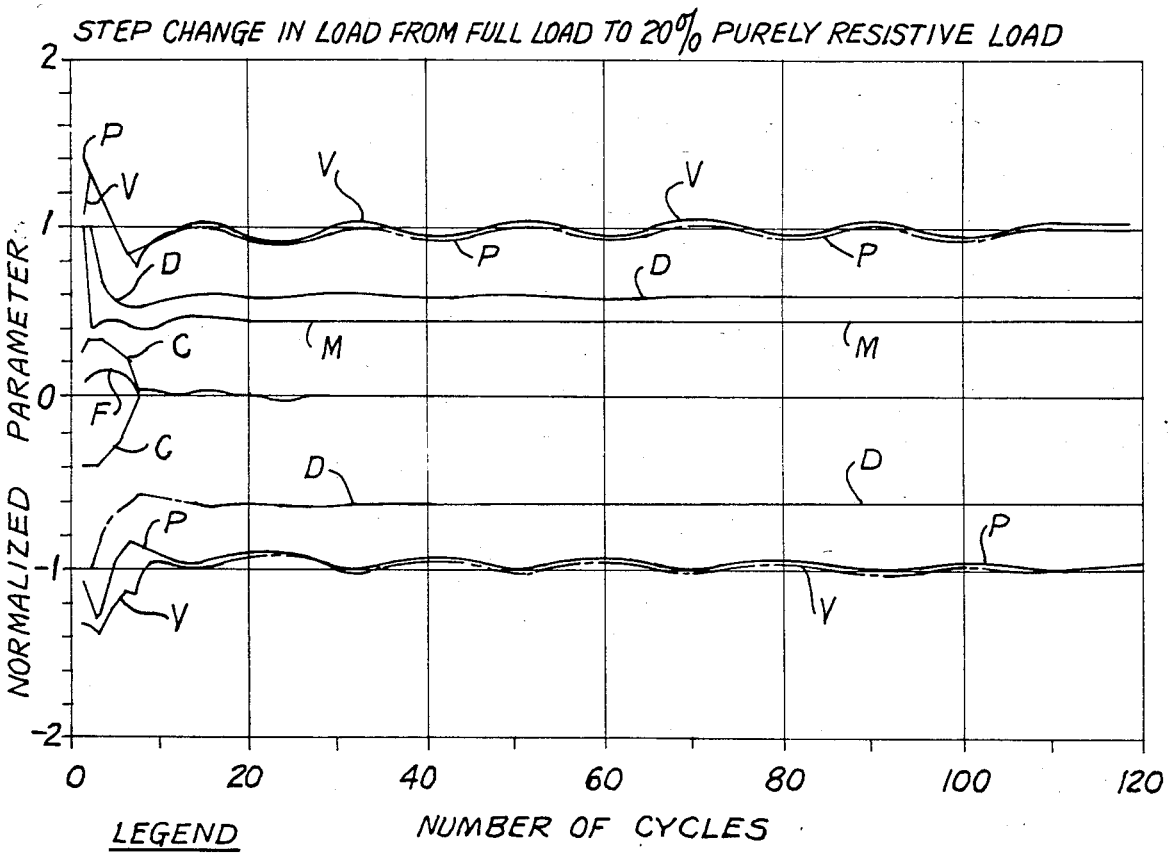
LEGEND
P - PISTON AMPLITUDE
V - LOAD VOLTAGE AMPLITUDE
D - DISPLACER AMPLITUDE
M - MOTOR VOLTAGE AMPLITUDE
C - SHUNT CIRCUIT AMPLITUDE
F - FREQUENCY - 60/10

EXTERNALLY EXCITED RESONANT FREE PISTON STIRLING ENGINE THERMAL AMPLIFIER SYSTEM AND METHOD OF OPERATION AND CONTROL THEREFOR

TECHNICAL FIELD

This invention relates to a resonant free piston Stirling engine (RFPSE) thermal amplifier system and its method of operation and to a novel control system therefor.

Free piston Stirling engines may be operated either as free running or damped "thermal oscillator" or as externally excited "thermal amplifiers." An externally excited, resonant free piston Stirling engine "thermal amplifier" is one which is over damped at its operating load levels and will not freely oscillate, but must be externally excited, in contrast to the free running "thermal oscillator" or damped "thermal oscillator" modes of operation. Over damping may be accomplished, for example, by properly designing the size of the effective displacer rod area which is exposed to the periodic pressure wave produced in the Stirling engine. Externally excited RFPSE thermal amplifiers can be caused to operate, for example, by driving the Stirling engine displacer member or the Stirling engine working piston, or by driving both the Stirling engine displacer and working piston. The present invention is especially advantageous for use in controlling the operation of an externally excited RFPSE thermal amplifier wherein a linear drive motor is coupled to and directly drives the displacer, and it will, therefore, be particularly described in that connection as the preferred embodiment of the invention.

BACKGROUND OF INVENTION

This invention provides a new and improved system and method of controlling resonant free piston Stirling engines (RFPSE) operated as a "thermal amplifier." U.S. Pat. No. 4,434,617, filed, July 27, 1982 and issued Mar. 6, 1984entitled, "Start-up and Control Method and Apparatus for Resonant Free Piston Stirling Engine'-'—Michael M. Walsh, inventor and assigned to Mechanical Technology Incorporated, Latham, N.Y. discloses an RFPSE system and method operated as a "thermal oscillator." In U.S. Pat. No. 4,434,617, the Stirling engine is designed for operation as a free running "thermal oscillator" or as a damped "thermal oscillator" by causing a displacer drive motor to be operated as a load.

The RFPSE described in U.S. Pat. No. 4,434,617 has a displacer reciprocally arranged within the housing of the Stirling engine which is subjected to a periodic pressure wave produced in the engine working gas operative to drive a working member or piston from which work is derived from the engine. Also, a linear dynamoelectric machine is arranged and constructed to be in driving arrangement with the displacer of the Stirling engine. A control excitation circuit provides a means for selectively causing the dynamoelectric machine to operate either as a drive motor, to supply drive energy to the displacer member, or to operate as a generator, to apply a load on the displacer. The term generator is used herein in its most generic sense to designate a machine which converts mechanical energy into electrical energy.

While the foregoing briefly described basic arrangement disclosed in U.S. Pat. No. 4,434,617, is entirely satisfactory, there is a continuing need to provide new and improved RFPSE systems and methods of operation thereof, and control systems therefor which more precisely and stably control the Stirling engine drive systems in a more comprehensive and reliable manner, particularly during transients caused by large and rapid load changes.

U.S. Pat. No. 4,215,548 issued Aug. 5, 1980, to Donald G. Beremand for a "Free-Piston Regenerative Hot Gas Hydraulic Engine," which is identified and distinguished over in U.S. Pat. No. 4,434,617, discloses a free piston Stirling engine having a free displacer with means for imparting motion to the displacer (pneumatic, electric or hydraulic). This means alledgedly controls the displacer operation so that the power piston completes its stroke prior to the reversal of the displacer piston and also provides control of the frequency at which the displacer piston is activated. As disclosed in FIG. 4 of that patent, an on-off type electric solenoid provides a convenient means of achieving such operation since by changing the polarity of the solenoid it can be made to drive the displacer to one end of the stroke or the other as required to generate the PV diagram shown in FIG. 6 of the patent. In the Beremand engine, frequency of switching the solenoid on and off controls the engine speed and hence the engine power. Changing frequency is not intended to change the displacer phase angle or stroke since it is stated that the intention of the Beremand system is to maintain the thermodynamic operation of each individual cycle of the engine constant from zero to maximum speed.

In the present invention, in contrast to the Beremand engine, steady state power is varied specifically by changing the thermodynamic operation of the RFPSE during each individual cycle. In particular, both the displacer stroke amplitude and the displacer phase angle are controllably varied by changing the voltage and frequency at which the electrodynamic drive motor is excited. In order for this system to operate properly according to the invention, it is not necessary that the reversal in direction of the displacer occur simultaneous to completion of the power piston stroke. This operation is in direct contrast to the Beremand engine mode of operation.

In the present invention means are provided to precisely control in a variable and stable manner the transient engine operations during rapid load changes in contrast, for example, to the prior Beremand engine and the Walsh engine.

SUMMARY OF INVENTION

It is therefore a primary object of this invention to provide a novel RFPSE thermal amplifier system and method for precisely and variably controlling such system in a stable manner.

Another object of the invention is to provide such a RFPSE thermal amplifier system and method which is capable of operating stably over the entire operating range of power output for which the RFPSE thermal amplifier is designed, and capable of maintaining adequate stability for large changes in load conditions within this range.

Still another object of the invention is to provide a novel system of the above type which maintains good steady-state regulation of the RFPSE thermal amplifier under all operating conditions.

A further object of the invention is to provide a novel RFPSE thermal amplifier-alternator system having the above discussed characteristics and which also provides good transient response for large changes in load.

In practicing the invention, an externally excited RFPSE thermal amplifier which is over damped at all load levels and does not freely oscillate, is provided together with a control system therefor. The system comprises a drive motor drivingly coupled with the displacer and/or piston mass of the Stirling engine and controllable power supply means connected with the drive motor to provide electrical input (voltage or current) thereto. The system further includes means for sensing at least one selected operating parameter of the RFPSE thermal amplifier or its drivingly connected load, and feedback means including means responsive to the sensed parameter signal for developing at least one feedback control signal operative to control the electric input supplied to the drive motor for controlling its operation and thereby control operation of the RFPSE thermal amplifier system in a precise, variable and stable manner.

In preferred embodiments of the invention, at least two different operating parameters of the RFPSE thermal amplifier are sensed and used to control the operation thereof. For this purpose the velocity of the working piston is sensed and a piston velocity feedback signal is derived along with a displacer velocity feedback signal indicative of the displacer velocity derived from a displacer velocity sensing means. The piston velocity feedback signal is then used to derive a feedback motor voltage control signal for controlling the magnitude of the excitation voltage supplied to the drive motor during operation of the RFPSE thermal amplifier. The piston velocity feedback signal and the displacer velocity feedback signal are phase compared in a phase detector to derive a displacer phase angle feedback signal indicative of the phase angle difference between the displacer and working piston of the RFPSE. The displacer phase angle feedback signal is then employed in deriving a drive motor feedback control signal for use in controlling the frequency of the excitation supplied to the drive motor to thereby control operation of the RFPSE thermal amplifier system.

In the preferred embodiment, the piston velocity feedback signal is further differentiated with respect to time to derive a differential piston velocity feedback signal that is fed back in parallel with the piston velocity feedback control signal. Also, the displacer phase angle feedback signal is differentiated with respect to time and the differentiated displacer phase angle feedback signal is fed back in parallel with the displacer phase angle feedback signal itself to derive the feedback frequency control signal.

In embodiments of the invention wherein the working piston of the RFPSE is coupled to and drives an alternator for supplying an electrical load, the system and method further includes sensing the output load voltage and deriving a load voltage feedback signal. The load voltage feedback signal is summed together with a reference value load voltage signal to derive a load voltage error signal that is integrated over time and summed together with the differentiated piston velocity feedback signal and the piston velocity feedback signal itself. The resultant signal is then summed with a reference input motor voltage signal to derive the desired output feedback motor voltage control signal for use in controlling the magnitude of the excitation voltage supplied to the displacer drive motor during operation of the RFPSE thermal amplifier system.

To further assure proper transient operation of the engine system, the control system and method further includes sensing the reactive motor current induced in the displacer drive motor and deriving a reactive motor current feedback signal proportional thereto. In the preferred embodiment this is accomplished by sensing the phase and magnitude of the motor current flowing in the drive motor and deriving a motor current phase feedback signal proportional thereto. The motor current phase feedback signal is phase compared to the displacer velocity feedback signal and a reactive motor current signal is derived. The reactive motor current signal is compared to a reference value and an error signal is derived. The error signal then is integrated with respect to time and summed with the feedback differentiated displacer phase angle feedback signal, the displacer phase angle feedback signal itself and with a drive motor reference frequency signal to derive an output drive motor frequency control signal for use in controlling the frequency of the excitation voltage supplied to the displacer drive motor during operation of the RFPSE thermal amplifier system.

The method and system according to the invention preferrably further includes proportionally amplifying the piston velocity feedback signal, the differentiated piston velocity feedback signal and the integrated load voltage error signal, respectively, in advance of the summing of these signals together with the reference input drive motor voltage signal to derive the output feedback motor voltage control. In addition, the integrated reactive motor error feedback signal, the differentiated displacer phase angle feedback signal and the displacer phase angle feedback signal, respectively, are proportionally amplified in advance of summing these signals together with the input drive motor reference frequency signal to derive the output drive motor frequency control signal, in order to minimize steady-state errors and settling time for system transients during operation of the Stirling engine thermal amplifier system.

BRIEF DESCRIPTION OF DRAWINGS

These and other objects, features and many of the attendant advantages of this invention will become better understood upon a reading of the following detailed description when considered in connection with the accompanying drawings, wherein like parts in each of the several figures are identified by the same reference character, and wherein:

FIG. 1A is a functional block diagram of a two-mass, RFPSE thermal amplifier system driving a linear alternator and having a linear drive motor directly coupled to and driving the displacer;

FIG. 7 is a schematic, functional block diagram of still a further externally excited RFPSE thermal amplifier system according to the invention for driving an alternator;

FIGS. 8A and 8B are timing wave forms illustrating the manner in which overshoot in the alternator output load voltage being generated by the alternator of FIG. 7, is sensed and damped by the insertion of a shunt resistance at the end of each operating cycle of the control system shown in FIG. 7; and FIG. 9 is a graph showing envelopes of the operating characteristics of a forced vibration RFPSE thermal amplifier driven alternator of FIG. 7, such characteristics being listed in the legend below FIG. 9.

BEST MODE OF PRACTICING INVENTION

Prior to the present invention, the traditional way to operate an RFPSE has been as a free-running thermal oscillator or as a damped thermal oscillator. The more advantageous method of operation made possible by the invention, is to operate the RFPSE as an externally excited thermal amplifier (or forced-vibration resonant system). There are very important and subtle differences between the two modes of operation which can best be explained by beginning with a brief description of both the traditional free running thermal oscillator mode of operation and the thermal amplifier mode.

Figure 1B:
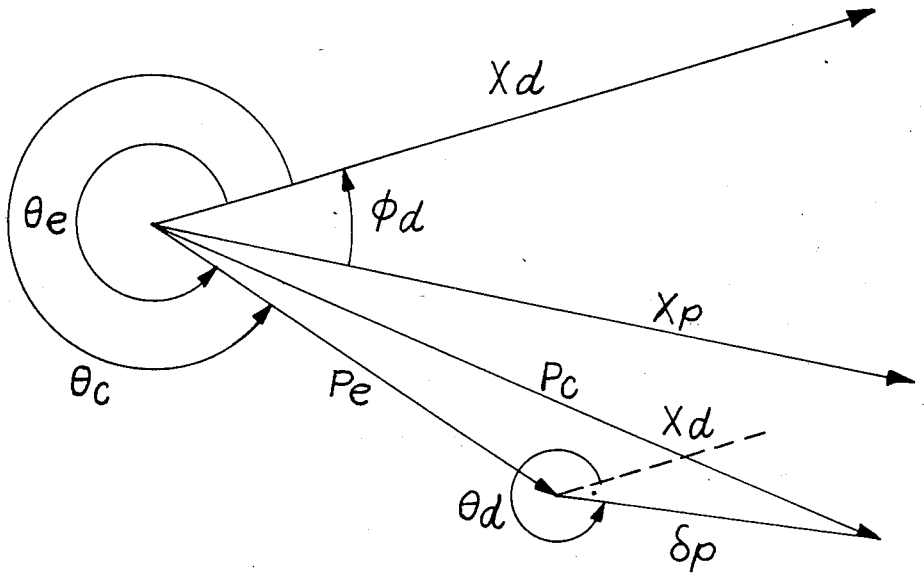
FIG. 1B is a phase diagram for the system of FIG. 1A.

FIG. 1A is a functional block diagram of a two-mass, forced vibration RFPSE thermal amplifier driven alternator according to the invention. In this arrangement, the two masses identified as a displacer and working member (power piston), are coupled together through the Stirling cycle thermodynamics. The motion of the displacer and the power piston according to classical Stirling engine theory, result in the production of a periodic pressure wave which lags the power piston motion. The amplitude and the phase angle of this pressure wave are defined by the volumetric displacement of the displacer and power piston, the temperature differential between the expansion and compression spaces, and the seal leakage and thermal hysteresis in the two spaces. The pressure drop in the heat exchangers results in pressure waves in the compression and expansion spaces ($P_c$ and $P_e$, respectively), which are not in phase with each other (FIG. 1B).

It has been determined that if the system free vibration modes are sufficiently over damped for all operating load conditions, and the feedback control system is properly designed, the system will be stable over its entire operating range. This is accomplished in the present invention by operating the RFPSE system as a forced vibration, externally excited thermal amplifier resonant system where the steady-state operating frequency is determined by the frequency of the forcing function. The forcing function itself is achieved with a linear dynamoelectric machine operated as a drive motor depicted by the element $E_m$ in FIG. 1A. Drive motor $E_m$ has its stator mounted on the engine housing and its armature secured to and linearly movable with the displacer of the RFPSE. An efficient method of damping the free vibration mode of the engine-alternator system for all loading conditions for operation as a thermal amplifier, is by properly sizing the effective area of the displacer rod as described more fully in copending U.S. Pat. No. 4,438,489, filed July 27, 1982, and issued July 10, 1984, entitled, "Resonant Free-Piston Stirling Engine Having Virtual Rod Displacer and Displacer Linear Electrodynamic Machine Control of Displacer Drive/Damping"—Michael M. Walsh, inventor and assigned to Mechanical Technology Incorporated of Latham, N.Y., the disclosure of which is hereby incorporated into the disclosure of this application in its entirety.

Referring to FIGS. 1A and 1B, the power $P_d$ in supplied to the displacer per cycle by the compression space pressure wave is given by the expression:

$$\hat{P}_{d\ in}=0.5\omega P_c A_r x_d \operatorname{Sin} \theta_c \tag{1}$$

Power consumed by the displacer per cycle $P_{d\ out}$ to over-come the displacer gas spring losses and the heat exchanger pumping losses is given by the expression:

$$P_{d\ out}=0.5\omega\delta_p A_d x_d \operatorname{Sin} \theta_d+0.5\omega^2 C_d x_d^2 \tag{2}$$

The displacer rod area $A_{rto}$ that is required to run the RFPSE system as a thermal oscillator is obtained from the power balance across the displacer as set forth in the following expression:

$$A_{rto}=\frac{\delta_p A_p \operatorname{Sin} \theta_d-\omega C_d x_d}{P_c \operatorname{Sin} \theta_c} \tag{3}$$

If the displacer rod area $A_r$ is smaller than $A_{rto}$, additional power has to be supplied to the displacer for the engine-alternator system to run as a thermal amplifier under prescribed dynamics. The amount of external power to be supplied to the displacer is direcly proportional to the rod area ratio $A_r/A_{rto}$.

To maintain the neutrally damped eigenvalue for various step load changes in a thermal oscillator system, requires instantaneous changes in a precise and stable manner of the system dynamic parameters such as stiffness and damping. etc., which is difficult (if not impossible) to implement in a practical and economic manner.

The system illustrated in the functional block diagram of FIG. 1A comprises a thermal amplifier system wherein external drive energy to the displacer supplied from the displacer linear dynamoelectric drive motor $E_m$, is amplified by the engine thermodynamic and is delivered to the load. The thermal amplification gain is a function of the rod area ratio $A_r/A_{rto}$ as determined by the range of loading conditions over which the RFPSE thermal amplifier driven alternator system has to operate precisely and stably.

Figure 2:
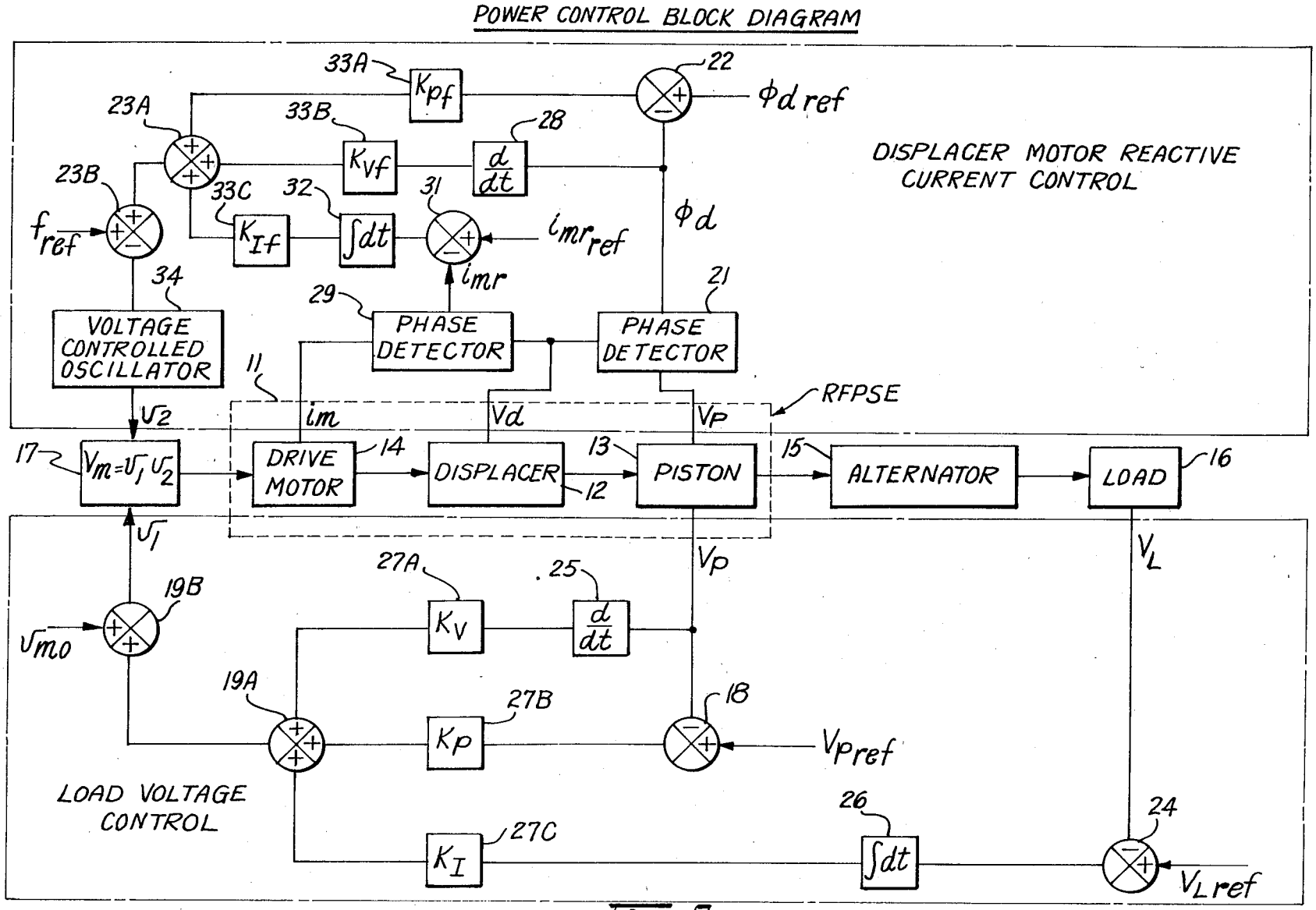
FIG. 2 is a schematic, functional block diagram of a novel externally excited RFPSE thermal amplifier system according to the invention and wherein a separately controlled displacer drive motor is directly coupled to and drives the displacer of the RFPSE thermal amplifier.

FIG. 2 is a schematic functional block diagram of a preferred thermal amplifier system for practicing the invention wherein a resonant free piston Stirling engine (RFPSE) is shown at 11 and comprises a displacer 12 and working piston 13 together with a displacer linear electrodynamic drive motor 14 that is directly coupled to and drives the displacer 12. The RFPSE 11 preferrably is of the type described in the above-referenced U.S. Pat. No. 4,458,489 wherein the effective area of the virtual displacer rod described in such application has been sized so that the displacer is fully damped for all operating load conditions of the RFPSE and will not freely oscillate. In the particular arrangement shown in FIG. 2, the working piston of the RFPSE is coupled to and directly drives an alternator 15 which supplies an electrical load 16. In operation, the drive motor 14 forces or drives the displacer 12 of the RFPSE so that the system operates as a thermal amplifier as described above.

The control for the thermal amplifier system shown in FIG. 2 comprises two main control sub-systems constituted by a load voltage control sub-system and a displacer motor reactive current control sub-system. The primary purpose of the load voltage control sub-system is to modulate the voltage amplitude of the excitation power supplied to the displacer drive motor 14 from a motor power supply circuit shown generally at 17 to be described more fully hereafter. The load voltage control sub-system accomplishes this purpose in such a manner as to keep the load voltage derived from alternator 15 substantially constant and the transient load voltage within a required band width for load changes within the operating load range of the system. The primary purpose of the displacer motor reactive current control sub-system is to limit the undershoot or overshoot of the phase angle of the displacer with respect to the power piston during transient operation and to make the steady-state displacer motor reactive current substantially constant over the operating load range of the system. The motor phase angle control is provided by modulating the frequency of the excitation power supplied to the displacer drive motor 14 by motor power supply 17 in such a manner that the drive motor supply frequency is a function of the displacer phase angle and the displacer motor reactive current.

In order for the externally excited RFPSE thermal amplifier to drive the alternator 15 in such a manner as to maintain the load voltage constant under varying load conditions, the drive motor 14 supply voltage is varied. The load voltage is proportional to the drive motor voltage at any given load, and frequency. A preferred method of modulating the drive motor supply voltage is to use a proportional feedback control which varies the drive motor voltage proportionally to the error between the actual load voltage, $V_L$, and the desired load voltage $V_{L\text{-}ref}$. However, since the feedback controlling signal $V_L$ is tapped directly from the load line this scheme can make the RFPSE thermal amplifier response excessively sensitive to electrical line noise. To reduce the influence of line noise, the effective feedback controlling signal derived from $V_L$ is buffered from the actual load. One way of achieving such buffering would be to provide a high frequency filter between the load voltage sensing element and the actual load. However, the introduction of a high frequency filter at this point in the system would introduce a time delay in the control action and therefore is not suitable for controlling relatively fast transients.

In the preferred embodiments of the invention shown in FIG. 2, a piston velocity feedback signal is derived and used to modulate the drive motor supply voltage so that the piston inertia provides the required buffer to any electrical line noise. In this arrangement, the piston velocity feedback signal can be used to control the load voltage because, for a linear alternator, the steady-state piston velocity is proportional to the steady-state load voltage. For this purpose, the velocity of the working piston 13 of the RFPSE is measured by a magnetic coil, optical transducer, or other suitable sensor (not shown) during each half cycle and a piston velocity feedback signal $V_p$ is derived. The piston velocity feedback signal $V_p$ is compared to a reference piston velocity signal $V_{p\,ref}$ in a first voltage control feedback signal summing circuit means 18 and a piston velocity error signal is derived. The piston velocity error signal is fed back through the first part 19A of a second voltage control feedback signal summing means (to be described hereafter) and to a second part 19B of the second voltage control feedback signal summing circuit means. In the second part 19B of the second summing circuit means, the voltage control feedback signal is summed with a reference input motor voltage signal $v_{mo}$ to derive a feedback motor voltage control signal $v_1$ that is used in partially controlling the drive motor power supply circuit 17.

In addition to the feedback piston velocity error signal, the piston velocity signal $V_p$ is differentiated in a differentiating circuit 25 and the differentiated signal supplied back through a proportional amplifier circuit means 27A having a respective proportional gain transfer characteristic for limiting initial piston velocity undershoot or overshoot during transient operation of the system. The differentiated and proportionally amplified piston velocity signal is then supplied to the first part 19A of the second summing circuit means for initially summing together with the piston velocity error signal which similarly is proportionally amplified in a proportional amplifier circuit means 27B for the purpose of limiting mid transient under or over shoot during transient operation of the system. The advantage obtained by using a differentiated or derivative control signal supplied through differentiating circuit 25 and proportional gain amplifier 27A is that the derivative signal is a measure of how fast the piston velocity signal is changing, and thus provides to the overall control system a capability for anticipating the piston velocity during sudden transient changes imposed on the overall system. By multiplying the piston velocity error signal in the proportional gain amplifier 27B by a proportional gain factor $K_p$ and by multiplying the derivative signal in the proportional gain amplifier 27A having a proportional gain characteristic $K_v$, the under/over shoot and settling time for transient changes can be reduced to an acceptable value. These proportional gain amplifiers may be either digitally operated amplifiers or may constitute conventional analog operational amplifiers depending upon design choice. If the proportional gain factors are too small, the undershoot or overshoot of the piston velocity during transients becomes large, resulting in large load voltage transients. On the other hand, if the proportional gain factors are too large, the settling time will be too long and the system will be unstable. Thus, the proportional gain factors are selected to be as large as possible with the upper limit being set by overall system stability. These design considerations are also true of the proportional gain characteristics of amplifier 27A and a proportional gain amplifier 27C, to be described hereafter. The differentiating circuit 25 may comprise a conventional RC differentiating circuit in the event that analog techniques are employed in implementing the system. In the event that digital techniques are employed, the amplitude of the piston velocity feedback signal $V_p$ can be determined for the last two consecutive half cycles of operation of the piston, and stored in a suitable memory. The time between the two piston velocity peaks is then calculated by means of a digital stop watch so that a rate of change of the velocity error signal is derived by dividing the change of velocity by the elapsed time (the division being performed by computation circuit in the digital differentiating circuit). The rate of change of velocity error signal then is multiplied by the velocity gain factor $K_v$ in the proportional gain amplifier circuit means 27A.

With the load voltage control system as thus far described, the proportional and derivative feedback loop will control the piston velocity during transients but can introduce a steady-state error in the load voltage. In order to eliminate the steady-state load voltage error, an error integration (reset feedback loop) is added in parallel with the above-described proportional and derivative piston velocity feedback loops. For this purpose the amplitude of the load voltage after each half cycle of operation of the RFPSE is sensed and a load voltage feedback signal $V_L$ is derived. The sensed load voltage feedback signal is compared to a desired load voltage reference signal $V_{L\ ref}$ in a third voltage control feedback signal summing circuit means 24 and a feedback load voltage error signal is derived which is representative of any difference. This feedback load voltage error signal is then integrated with respect to time in an integrating circuit 26 (again either using an operational amplifier or a digital integrating circuit) and then multiplied by an integral feedback gain $K_I$ in a proportional gain amplifier circuit means 27C similar to proportional gain amplifiers 27A and 27B described above. This amplified integrated load voltage error feedback signal is then employed to modulate the drive motor supply voltage by adding it in the first part 19A of the second summing circuit together with the proportionally amplified piston velocity error signal and differentiated piston velocity error signal. The resultant feedback signal then is supplied as one input to the second part 19B of the second feedback signal summing circuit means for summing together with the reference input motor voltage signal $V_{mo}$ to derive the desired feedback motor voltage control signal $v_1$ supplied to the drive motor power supply circuit 17. With this added feature, as long as a difference exists between the actual load voltage and the reference load voltage, the integral feedback signal will continue to change the drive motor voltage until the difference is reduced to zero.

As noted earlier above, the primary purpose of the displacer motor reactive current control sub-system is to limit the change in the phase angle of the displacer with respect to the power piston during transient operations and to make the steady-state motor reactive current constant over the operating load range. It is necessary to limit the displacer phase angle to positive values during transient operation due to the fact that a change in reactive load on the system results in a change in spring force component on the power piston of the RFPSE. This results in a transient change in the oscillatory frequency of the power piston, which, during the transient, can result in sufficient overshoot of the piston phase relative to the displacer so as to make the displacer phase angle very low and perhaps even negative with respect to the power piston. A very low phase angle limits the power which can be generated by the system. A negative displacer phase angle reverses the power flow direction in the system and can result in large system oscillations. To prevent this from happening, the displacer phase angle has to be limited to high positive values during transient operations of the system.

One of the effective ways of controlling the displacer phase angle is by changing the supply frequency of the excitation voltage supplied to the displacer drive motor 14. If during system transients, the displacer phase angle increases, the motor frequency is reduced. Conversely if the displacer phase angle decreases, the motor supply frequency is increased. To implement this scheme, the phase angle between the displacer and the power piston is measured by first sensing the piston velocity and the displacer velocity and deriving respective piston velocity and displacer velocity feedback signals whose magnitude and phase are representative of the piston velocity and the displacer velocity. The phase angle between the displacer and the power piston is then calculated at the end of each half cycle by measuring the time delay between the peaks of the piston velocity and displacer velocity signals in a suitable phase detector circuit 21 which may be implemented using either digital or analog techniques. A displacer phase angle feedback signal $\phi_d$ is then derived from the phase detector 21 and supplied to one input of a first phase angle feedback signal summing circuit means 22. A reference displacer phase angle signal $\phi_{d\ ref}$ is supplied as a second input to the first phase angle feedback signal summing circuit 22 and a phase angle error feedback signal is derived which is supplied through a proportional gain amplifier circuit 33A (similar in nature to the proportional gain amplifier circuits 27A, 27B and 27C described earlier above), and the proportionally amplified, phase angle error feedback signal then supplied as an input to a first part 23A of a second phase angle feedback signal summing circuit means.

The displacer phase angle feedback signal $\phi_d$ also is differentiated with respect to time by a differentiating circuit means 28 to derive a differentiated displacer phase angle feedback signal indicative of the rate of change of the displacer phase angle. The differentiated or derivative signal then is proportionally amplified by a proportional gain amplifier 33B and the amplified differentiated, displacer phase angle feedback signal also supplied as a second input to the first part 23A of the second phase angle feedback signal summing circuit means.

The drive motor alpha angle is the angle between the phase of the drive motor current and the phase of the displacer velocity and is a measure of the amount of reactive current flowing through the displacer drive motor circuit. If the drive motor alpha angle is zero or 180 degrees, the motor reactive current is zero. If the drive motor alpha angle is 90 or 270 degrees, the current flowing through the drive motor is all reactive. If the steady-state drive motor alpha angle is not maintained constant and close to zero a large change in drive motor voltage supplied from the voltage control sub-system will introduce a large reactive force component on the displacer and thus change the oscillatory frequency of the displacer. A large change in the displacer oscillatory frequency results in a changing phase angle between the displacer and the power piston which in turn can result in improper system response to the drive motor voltage change. While certain embodiments (not shown) with a constant but non zero steady-state alpha angle can use this effect to advantage, in the present system it becomes necessary to maintain the steady-state drive motor alpha angle constant. This function is provided by a third drive motor reactive current feedback loop having its output supplied as a third input to the first part 23A of the second phase angle feedback signal summing means.

The drive motor reactive current feedback loop is comprised by a second phase detector 29 having the displacer velocity feedback signals $V_d$ supplied thereto as one input and having a drive motor current signal $i_m$ supplied thereto as a second input. The drove motor current feedback signal $i_m$ is obtained by a suitable current sensor and is representative of the magnitude and phase of the displacer drive motor current and the displacer velocity feedback signal $V_d$ is representative of the magnitude and phase of the displacer velocity. The phase detector 29, similar to phase detector 21, may be implemented using either digital or analog techniques and operates to compare the amplitude and phase of the drive motor current $i_m$ to the displacer velocity $V_d$ and to derive a feedback drive motor reactive current component signal $i_{mr}$. The feedback drive motor reactive current component signal $i_{mr}$ is summed together with a reference value drive motor reactive current signal $i_{mr\,ref}$ in a third phase angle feedback signal summing circuit means 31 to derive at its output a drive motor reactive current error signal. The drive motor reactive current error signal is integrated in a drive motor reactive current error signal integrating circuit 32, similar to the integrating circuit 26, and the integrated drive motor reactive current error signal, after proportional amplification in amplifier 33C is supplied as a third input to the first part 23A of the second phase angle feedback control signal summing circuit means.

Summing circuit 23A sums together the integrated drive motor reactive current error signal, the differentiated displacer phase angle feedback signal and the displacer phase angle feedback signal and supplies a feedback correction signal to the second part 23B of a second phase angle (reactive current) feedback signal summing circuit means. In 23B the feedback correction signal is summed with an input drive motor reference frequency signal $f_{ref}$ to derive the displacer motor phase angle feedback control signal. The displacer motor phase angle feedback signal then is employed to drive a voltage controlled oscillator 34 for deriving frequency control signals $v_2$ for use in controlling frequency of operation of displacer drive motor 14 in conjunction with the feedback motor voltage control signal $v_1$. The motor voltage control signal $v_1$ and the frequency controlling signal $v_2$ are supplied to the electrical power converter circuit 17 for use in controlling the magnitude and the frequency, respectively, of the excitation voltage supplied to the drive motor 14 by power converter 17. With this arrangement, if during transients, the displacer motor phase angle increases, the drive motor excitation voltage frequency is reduced and if the displacer phase angle decreases, the drive motor excitation voltage frequency is increased. In addition, the frequency of the drive motor excitation voltage is adjusted by the feedback drive motor phase angle control signal so that the steady-state drive motor reactive current component is maintained substantially at a constant value, $I_{mr\,ref}$, over the entire operating load range of the system.

Figure 3A:
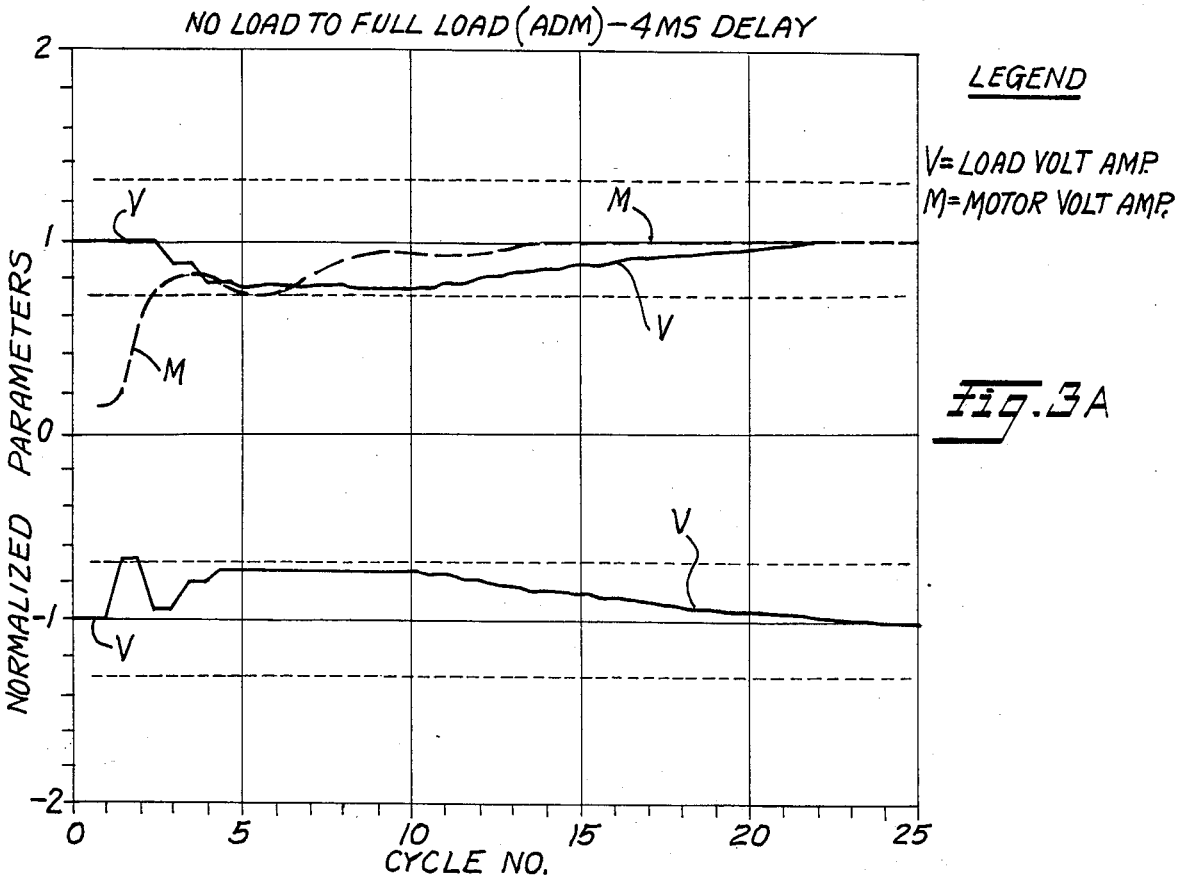
FIGS. 3A, 3B, and 3C are operating characteristic curves showing certain critical operating characteristics of the RFPSE thermal amplifier system of FIG. 2.
Figure 3B:
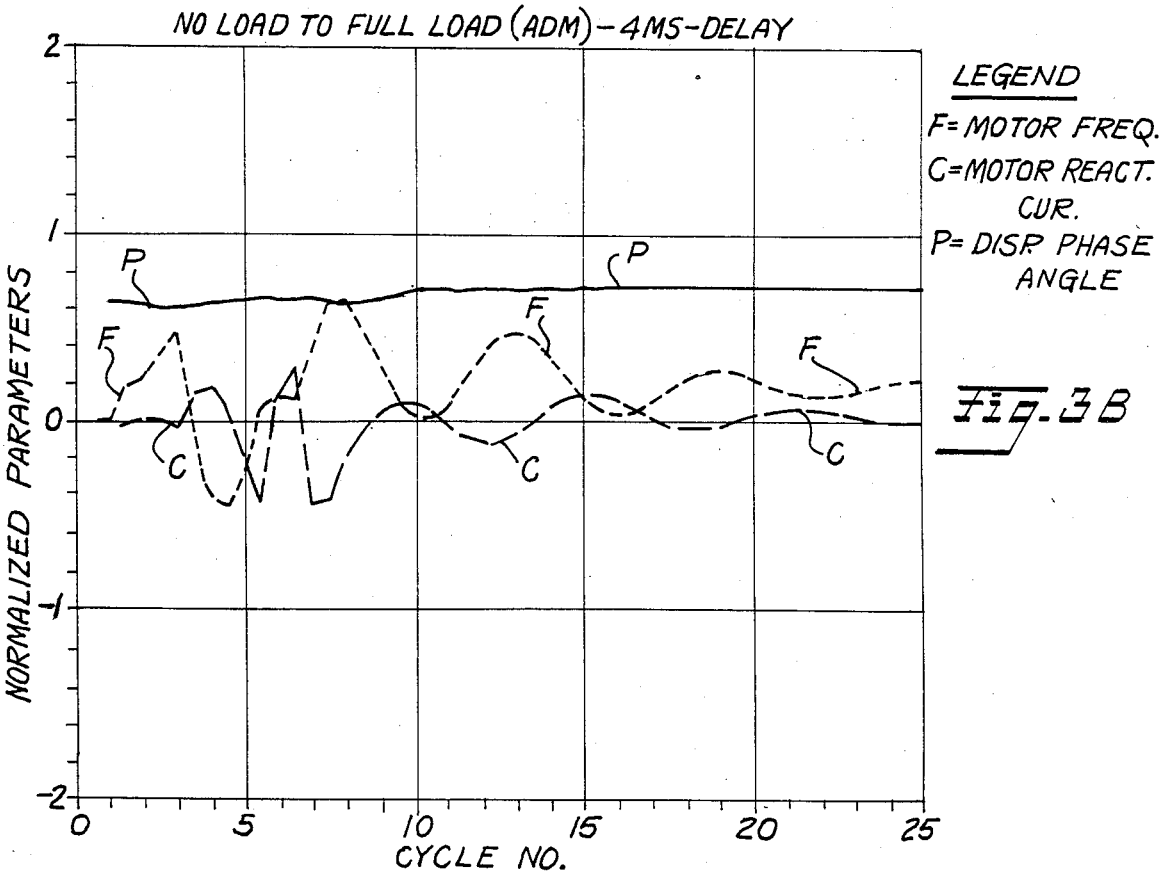

FIGS. 3A and 3B are computer printouts of the operating characteristics of the new and improved thermal amplifier system shown in FIG. 2 of the drawings. In FIG. 3A the load voltage is plotted for a transient change in loading from no load to full load following a 4 millisecond period and occupying some 25 cycles at a nominal operating frequency of 60 Hertz. The load voltage characteristic shown in solid lines is identified as V and the displacer motor voltage characteristics shown by the dashed line curve M. The design operating bands for the system are shown in dotted outline. It will be seen from FIG. 3A that the system operates to maintain the solid line load voltage characteristic centered on its steady-state amplitude value of $+1$ or $-1$ after accommodating transient changes. The motor voltage and load voltage are normalized to full load steady-state amplitude.

FIG. 3B of the drawings illustrates the motor frequency F in a dotted curve, the motor reactive current in a dashed curve C and the displacer phase angle in the solid line curve P. The curves shown for a comparable transient change from no load to full load following a 4 millisecond delay and occupying some 25 cycles of the 60 Hertz nominal operating frequency. From FIG. 3B, it will be seen that the displacer phase angle is maintained substantially constant throughout the transient change with the frequency F being subjected to damped variations that eventually approaches the new steady-state operating frequency value.

Figure 3C:
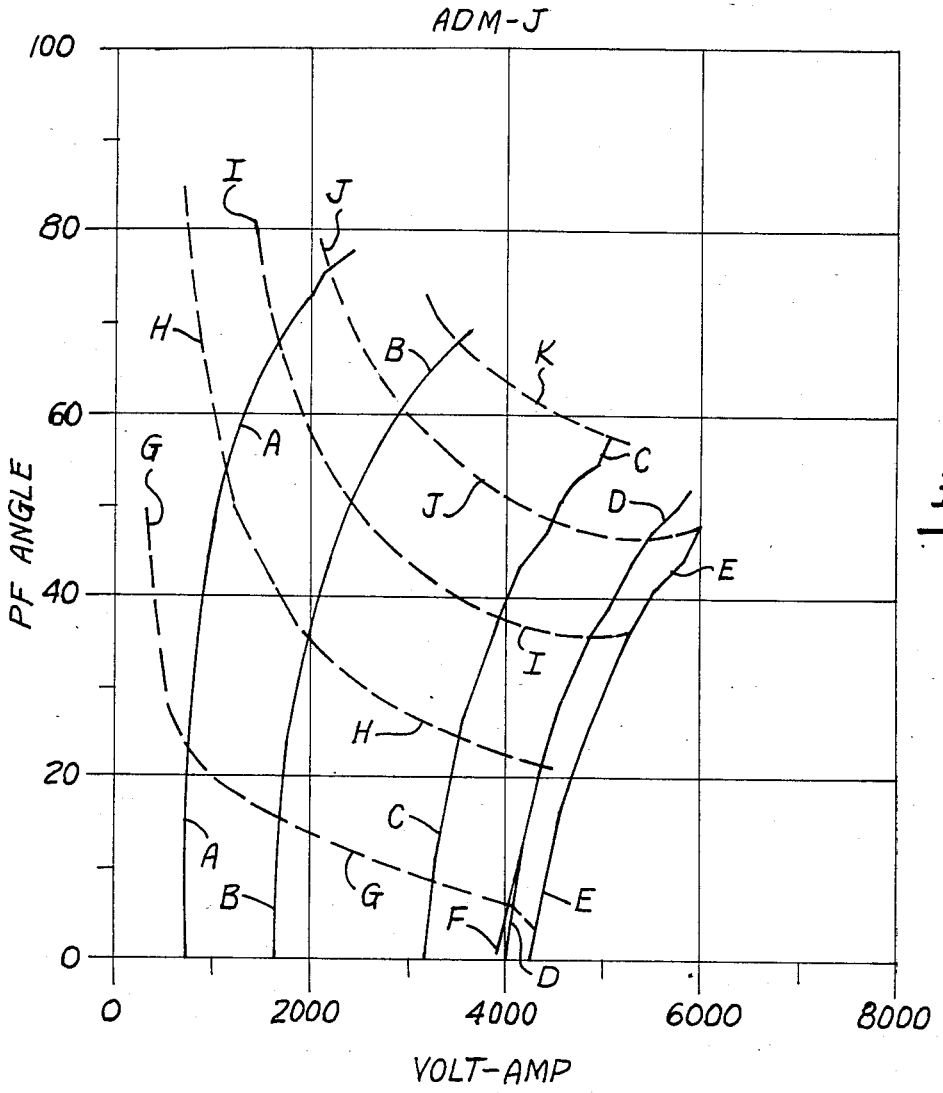

FIG. 3C of the drawings is a load voltage-ampere versus power factor phase angle map operating characteristic for the system of FIG. 2. By plugging a desired volt-ampere output versus operating phase angle value into the map of FIG. 3C, a prescribed operating frequency for the system can be determined. Alternatively, the operating frequency and desired load volt-ampere values can be employed to derive the desired phase angle of operation from the map of FIG. 3C or if the operating phase angle and frequency are known, the predicted output volt-ampere can be determined.

Figure 6:
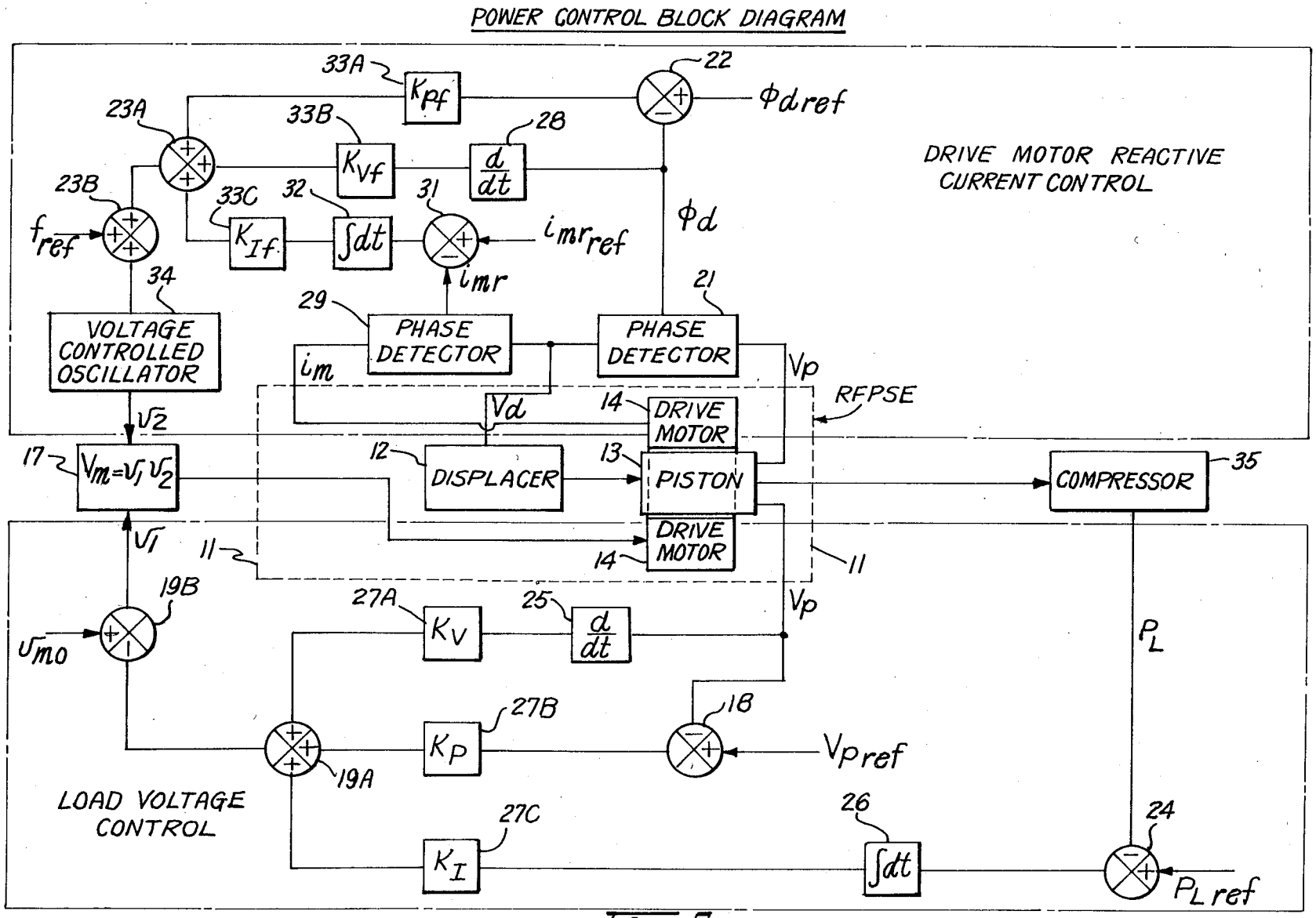
FIG. 6 is a schematic, functional block diagram similar to that of FIG. 2 with the exception that the separate, external drive motor is coupled to and directly drives the working piston of the RFPSE thermal amplifier and the load being driven is a directly driven compressor.

From FIG. 3B of the drawings, it will be seen that the thermal amplifier system of FIG. 2 has a tendency to drift away from its nominal frequency of operation during transient changes in loading. This is due to the fact that operation of the frequency feedback control subsystem as thus far described causes the steady-state engine frequency to vary in such a manner as to maintain the steady-state motor reactive current component constant. As a consequence, the control system as thus far described does not possess inherent frequency regulation and the steady-state operating frequency will change with changes in load. Such frequency variations may be totally consistent with good and proper operation of the system; for example, in the case of a free-piston engine driving a compressor load as shown in FIG. 6 to be described hereafter. In other applications, specifically the RFPSE driving an alternator, the allowable frequency variation with load can be an important system performance requirement. The predicted variation of frequency with load for a typical RFPSE driving an alternator is shown in FIG. 3B. The nominal operating frequency for this engine system is 60 Hertz. From FIG. 3C the maximum steady-state operating frequency is 61 Hertz and the minimum steady-state operating frequency is 59 Hertz. In many alternator applications, this degree of frequency variation is totally consistent with good and proper operation of the system.

In cases where good and proper system operation requires tighter frequency regulation with load or where good and proper system operation requires the frequency to be either manually or automatically adjustable, additional control means are provided to operate in feedback relationship with the frequency control subsystem. Operation of the frequency control subsystem involves changing the driver motor excitation frequency so as to tune (resonate the system at its natural frequency) the RFPSE to a given value of motor reactive current. The frequency control adjustment subsystem operates to vary the RFPSE operating dynamics so as to vary the frequency at which the RFPSE tunes to the given value of motor reactive current. Typical dynamic parameters which may be varied are the engine operating pressures, the displacer spring coefficient, the piston spring coefficient or some combination of these parameters. In the preferred embodiment, the engine pressure is varied by means shown in FIG. 4 of the drawings.

Figure 4:
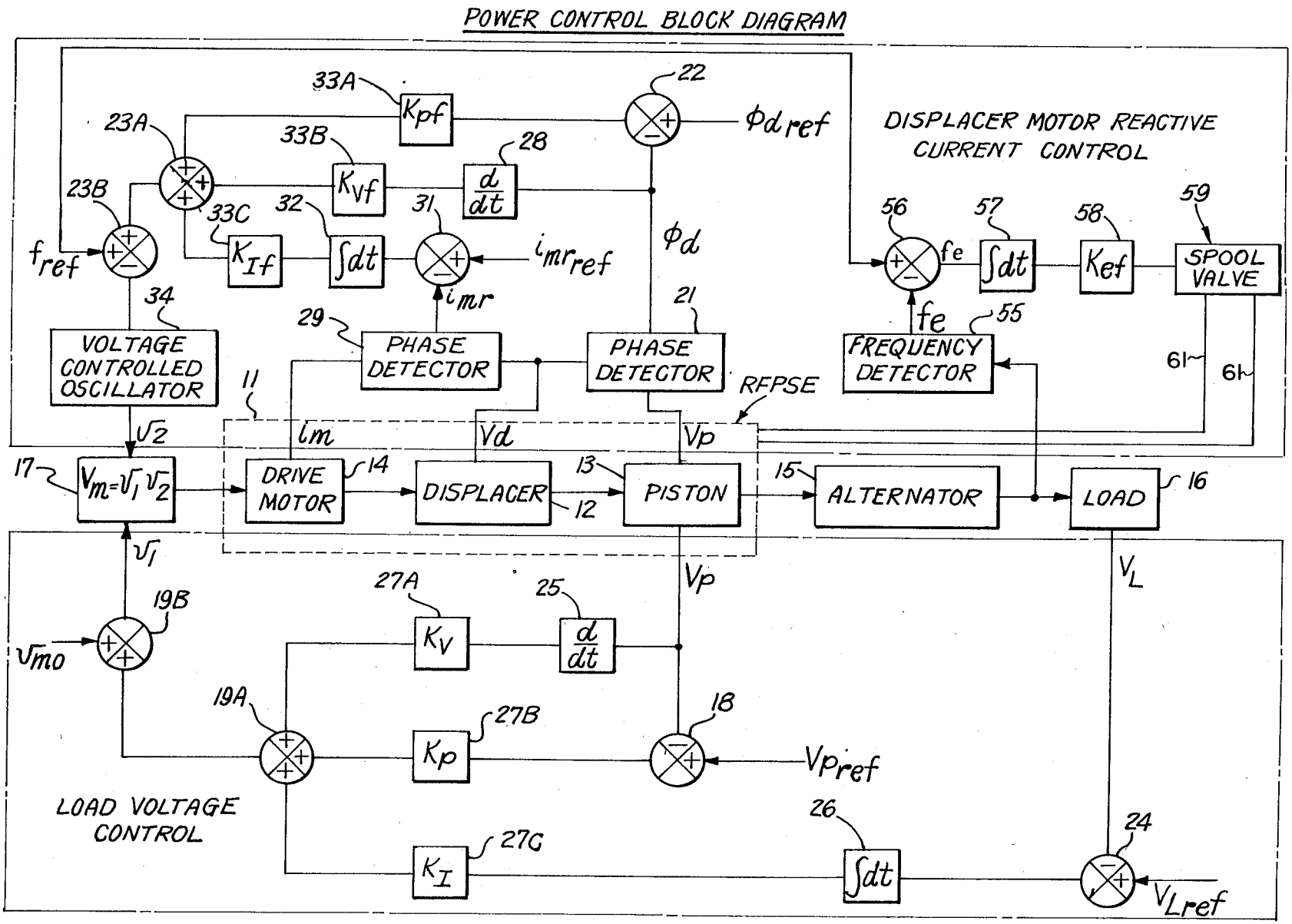
FIG. 4 is a schematic, functional block diagram of a modified form of the system shown in FIG. 2 of the drawings for use with those job applications where precise frequency regulation of the RFPSE thermal amplifier system output is required as, for example, with certain types of RFPSE thermal amplifier driven alternator equipment.

Referring to FIG. 4, the additional frequency control is provided by a frequency detector 55 which senses the output frequency of the alternator 15 and derives an output load frequency signal $f_l$ that is supplied to a frequency signal summing circuit 56. The frequency signal summing circuit 56 also is supplied with the desired input reference frequency signal $f_{ref}$ and sums these two signals together to derive an output frequency error signal $f_e$. The output frequency error signal $f_e$ is supplied to the input of an integrating circuit 57 for integrating the frequency error signal over a period of time representative of a number of operating cycles (approximately 20) and supplying its output to a proportional amplifier 58. The output from proportional amplifier 58 then is applied to a control solenoid of a spool valve 59 to be described hereafter with relation to FIG. 5. Spool valve 59 operates to control pressure in the RFPSE 11 through interconnecting pneumatic lines indicated by lines 61 in FIG. 4. By this arrangement, spool valve 59 is controlled in such a manner as to vary the pressure of the working fluid in the RFPSE 11 housing so as to retune the natural resonant frequency of the RFPSE to the new operating conditions and the maintain the output load frequency $f_l$ substantially constant at its desired operating value.

Figure 5:
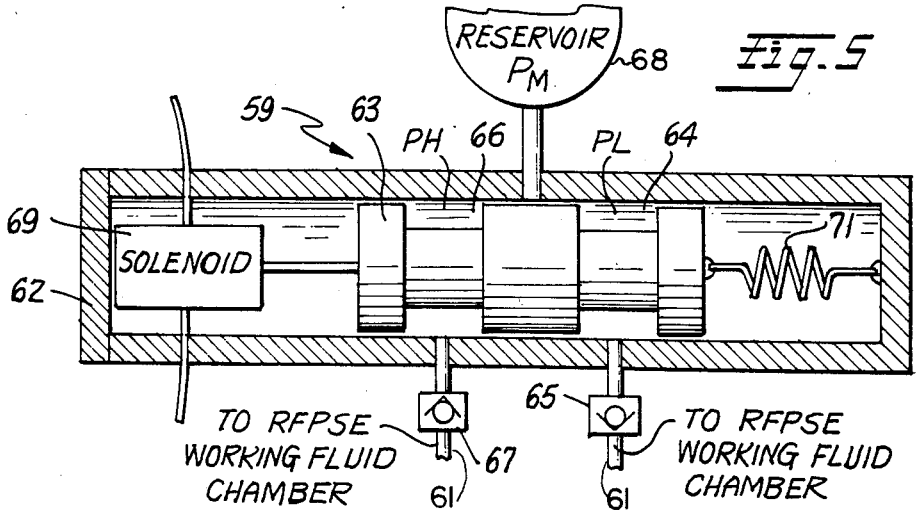
FIG. 5 is a partial sectional view of a working fluid pressure control spool valve for use with the system of FIG. 4.

FIG. 5 illustrates the construction of a suitable spool valve 59 for controlling the pressure of the working fluid in the RFPSE 11 to thereby control its frequency of operation and maintain it at a desired operating value. The spool valve shown in FIG. 5 is comprised by a housing 62 in which is slidably supported a plunger member 63. Plunger member 63 defines two chambers identified as 64 and 66. The chamber 64 contains operating fluid gas maintained at the minimum or lowest pressure of operation of the operating fluid gas within the RFPSE 11 identified as $P_L$. Chamber 66 in contrast is filled with a fluid gas maintained at a pressure $P_H$ which is the highest operating gas pressure for which the RFPSE 11 is designed to operate. A reservoir 68 is connected to the housing 11 at a position which is intermediate the two chambers 64 and 66 but which can be interconnected selectively to either chamber through the medium of the plunger 63 when it is slid either to the right or to the left from its central position shown in FIG. 5. The reservoir 68 is filled with a fluid operating gas at a median pressure $P_m$ which is intermediate of the high pressure $P_H$ and the low pressure $P_L$ in the respective chambers 66 and 64. The low pressure gas chamber 64 is interconnected via a check valve 65 to the RFPSE working fluid chamber and the high pressure chamber 66 is interconnected through a check valve 67 to the RFPSE working fluid chamber. By this arrangement under conditions where the working fluid pressure of the RFPSE is too low, the pressure of the working fluid can be increased by moving the plunger 63 to the left and thereby increasing the low pressure $P_L$ in chamber 64 which therefore would interconnect through check valve 65 to the RFPSE working fluid chamber to thereby increase the operating fluid gas pressure. Conversely, if the operating gas pressure of the RFPSE is too high, it can be lowered by sliding the plunger 63 to the right thereby interconnecting chamber 66 with the reservoir 68 and allowing working fluid gas to be bled off through the check valve 67 into the reservoir 68 to thereby lower the operating fluid gas pressure in the RFPSE.

The plunger 63 is connected at one end to a solenoid 69 which is excited by the signal supplied from the proportional amplifier 58 of the thermal amplifier system shown in FIG. 4. At its other end plunger 63 is connected to a combined compression/tension spring 71 for centering the plunger member 63 substantially in the central position shown in FIG. 5. Under conditions where the frequency of the output electrical signal developed by alternator 15 tends to drift higher than its desired reference value $f_{ref}$ due to the operating fluid working pressure increasing above the designed highest value $P_H$, the signal from proportional amplifier 58 will actuate solenoid 62 so as to drive plunger 63 to the right thereby bleeding off working fluid from the RFPSE working fluid chamber. Conversely, under conditions where the working fluid pressure is too low and the output frequency from alternator 15 drops below the desired reference frequency value $f_{ref}$, the signal from proportional amplifier 58 will cause solenoid 69 to pull plunger 63 to the left from its mid-position shown in FIG. 5, thereby adding additional working fluid to the RFPSE working fluid chamber thru check valve 65 as described above. In this manner, it will be seen that the additional frequency control feature provided by the elements 55–71 acting in conjunction with the other control subsystems, will serve to maintain the output operating frequency of the alternator at its designed value.

FIG. 6 is a schematic, functional block diagram of a modified form of the control system shown in FIG. 2 according to the invention and wherein like parts in each of the figures has been identified by the same reference character. The FIG. 6 system differs from the system shown in FIG. 2, however, in two major respects. In the system of FIG. 6, the drive motor 14 is mounted on and directly drives the working piston 13 of the RFPSE in place of driving the displacer as shown in the system of FIG. 2. A second major distinction is that a compressor 35, pump or other similar apparatus is directly driven by the working piston 13 of the RFPSE in place of the alternator and load shown with the system of FIG. 2. In all other respects, the two systems are similar.

In operation, the operating parameters of the Stirling engine thermal amplifier that are sensed and used in controlling operation of the system, are similar to those described with reference to the FIG. 2 embodiment of the invention. However, in place of sensing the load voltage of the alternator output, the pressure, stroke or other operating parameter of the compressor apparatus 35 is sensed and used as the load operating parameter controlling feedback signal. For this purpose the operating pressure of the compressor 35 is sensed by a suitable pressure sensor (not shown) and a compressor pressure feedback signal $P_L$ is supplied to one input of the third motor voltage control feedback signal summing circuit means 24 along with a reference value compressor pressure signal $P_{L\ ref}$ and a feedback pressure error signal is derived from the summing circuit 24. The pressure error signal is integrated in the integrating circuit 26, proportionally amplified in proportional amplifier circuit 27, and supplied as one input to the first part of the second motor voltage control feedback signal summing circuit means 19A. The integrated pressure error signal is summed together with the proportionally amplified piston velocity signal $V_p$ and the proportionally amplified, differentiated piston velocity signal to derive a feedback error correction signal that is summed with the reference drive motor voltage signal $v_{mo}$ in the second motor voltage control feedback summing circuit means 19B to derive the feedback drive motor voltage control signal $v_1$.

The displacer motor reactive current control sub-system of FIG. 6 works identically to that described with relation to FIG. 2, except that the sign of frequency feedback signal is inverted to account for the fact that changing the drive frequency of the piston has an opposite effect to changing the drive frequency of the displacer. That is, whereas increasing displacer drive frequency increases displacer phase angle, increasing piston drive frequency decreases displacer phase angle. The frequency controlling feedback signal $v_2$ is applied to the power converter circuit 17 in conjunction with the motor voltage feedback signal $V_1$ to thereby control the magnitude and frequency of the excitation voltage supplied to drive motor 14 by power converter circuit 17 to thereby control operation of the RFPSE thermal amplifier driven compressor system shown schematically in FIG. 6 of the drawings.

FIG. 7 is a schematic, functional block diagram of a control system for a forced vibration RFPSE thermal amplifier 41 having a linear displacer drive motor 40 and driving an alternator 42 for supplying a load 43 according to the invention. A closed-loop control arrangement is employed to vary the supply voltage $V_S$ supplied to the displacer drive motor 40 with changes in load. The main voltage control feedback loop comprises a proportional control based on the error between the actual alternator load voltage $V_L$ produced across load 43 and the desired steady-state alternator load voltage $V_D$. For example, if the actual alternator load voltage is greater than the desired voltage, the feedback loop signals will reduce the supply voltage $V_S$ supplied to the linear displacer drive motor in proportion to the error signal which is equal to the actual alternator load voltage $V_L$ minus the desired load voltage $V_D$. This comparison is made in a first comparator summing circuit 44 which derives at its output an error signal $\epsilon$ that is fed back through a proportional gain amplifier circuit 45 to one input of a feedback drive motor control voltage summing circuit 46 along with a preselected reference drive motor voltage $V'_{mo}$. Summing circuit 46 sums these two signals together (along with others to be described hereafter) and derives the output feedback drive motor control signal $V_S$ for supply to displacer drive motor 40.

Due to the fact that the preselected reference drive motor voltage $V'_{mo}$ will not necessarily correspond to the steady-state voltage required to maintain a desired load voltage under all load conditions for the alternator, the proportional control system thus far described will tend to introduce a steady-state error in the actual load voltage $V_L$. To compensate for this effect, the proportional gain amplifier circuit 45, which may comprise an operational amplifier having a proportional gain characteristic $K_p$, is inserted in the feedback loop. The proper selection of the proportional gain characteristic $K_p$ is based on a compromise between the settling time of the system transients and the steady-state error of the load voltage. If the selected value of $K_p$ is made large, the steady-state error is small but the settling time of the Stirling engine transients becomes larger and vice versa. If the transfer function $K_p$ is too large, the system will become unstable. Hence, appropriate compromise must be made in the value of $K_p$.

In order to eliminate the steady-state error, an error integration (reset) feedback loop is provided in parallel with the main voltage feedback control loop. This comprises an integrating circuit 47 and a proportional gain amplifier having a proportional gain characteristic $K_i$ where $K_i$ is the effective integral feedback gain. As $K_i$ is increased, the settling time of the system transients is reduced; however, if $K_i$ is made too large the system becomes unstable.

As described thus far, the drive motor supply voltage $V_s$ supplied at the output of the summing circuit is given by the expression:

$$V_m = V_{mo} + K_p\epsilon + K_i\int \epsilon dt \tag{4}$$

where $V_{mo}$ equals the preselected reference drive motor voltage, $K_i$ equals the effective integral feedback gain, $K_p$ is the gain of amplifier 45 and $\epsilon$ equals the load voltage error.

In some cases the voltage feedback signals alone may not be sufficient for the control system, as thus far described, to meet step changes in load for all loading conditions. To overcome this problem, a current feedback loop is provided to set the displacer drive motor preselected reference voltage $V_{mo}$ and includes a proportional gain amplifier circuit 48, which may be an operational amplifier having a transfer function $XK_{pc}$. With this arrangement the motor reference voltage $V_{mo}$ becomes:

$$V_{mo} = V'_{mo} + XK_{pc}i_L \tag{5}$$

where $i_L$ is a feedback signal representative of the load current amplitude and $V'_{mo}$ is an input load reference voltage median value signal to be adjusted by the load current feedback signal. $V_{mo}$ and the proportional gain characteristic $XK_{pc}$ are calculated by linear current fitting of the steady-state load current and motor supply voltage required to maintain a fixed steady-state load voltage for all load conditions. With this addition in the control system, the positive current feedback loop ($XK_{pc}$) becomes the major controlling factor for the load voltage and the negative feedback loop ($K_p$ and $K_i$ loops treating the error signal $\epsilon$) are primarily used for tuning the load voltage. In operation the control system samples the load voltage and load current and sets the voltage $V_S$ supplied to the displacer drive motor 40 at the end of each cycle.

The control system of FIG. 7 as thus far described provides the proper steady-state response to load changes; however, it may not limit voltage over/undershoot within acceptable limits. To limit the transient overshoot/undershoot of the load voltage, it is desirable to perform a control action as soon as possible after transient load changes, rather than after the end of an operating cycle of the load alternator/generator. For this purpose, an additional control loop is provided for inserting a shunt resistance in parallel with the load 43 at the instant that the instantaneous load voltage increases above a certain set value (for example 15% above the maximum rated value). For this purpose, a comparator circuit 49 is provided which is supplied with an input signal $V_L$ representative of the actual instantaneous value of the load voltage and a signal $V_{LM}$ representative of the maximum value of load voltage. Any difference in the value of the two signals in a negative going direction due to $V_L$ being greater than $V_{LM}$ results in a switching circuit 51 being actuated which in turn automatically actuates a power switch 52 for connecting a shunt resistor 53 in parallel circuit relationship with the load 43. The instantaneous nature of this switching action is such that the resistance value $R_S$ provided by shunt resistor 53 can be inserted in parallel with the load at any point during an operating cycle of the RFPSE thermal amplifier driven alternator 42. Once the shunt resistor 53 is connected, it is kept connected in the circuit until the end of N load operating cycles whereupon the switching circuit 51 automatically causes power switch 52 to open. This may be readily achieved, for example, by including a suitable end of cycle sensing and counting means in switching circuit 51.

The shunt resistor switching action described above is depicted in FIGS. 8A and 8B of the drawings wherein it is seen that if the instantaneous load voltage $V_L$ exceeds the maximum value $V_{LM}$, switch 52, which normally is open, automatically closes and will remain closed until the end of N operating cycles when it again opens. Thus the value of the alternator load voltage is sampled during each operating cycle and under conditions where the maximum load voltage $V_{LM}$ is exceeded, the shunt resistance 52 is connected in the circuit and maintained in the circuit until the end of N operating cycles from the cycle in question. As a result of the switching in of the shunt resistance 52, the engine senses a smaller change in load than that which actually occurs. This reduces the load voltage instantaneously and in addition the energy which otherwise would result in overshoot is dissipated in the shunt resistance.

As soon as the shunt resistance is applied in the above-described manner, the effective load on the engine-alternator system is different than the actual engine load. To compensate for this effect, an additional negative feedback loop employing a proportional gain amplifier circuit 54 is provided for sampling the current $i_s$ flowing in shunt resistor 52, processing it in an operational amplifier having a proportional gain characteristic $-K_{pc}$ and supplying the processed negative feedbacl signal to the main drive motor feedback control signal summing circuit 46 for summing together with the feedback signals supplied from the previously described feedback loops. As a result, voltage $V_M$ supplied to the linear displacer drive motor 40 becomes:

$$V_m = V'_{mo} + XK_{pc}i_L + K_p\epsilon + K_i\int \epsilon dt - K_{pc}i_s \quad (6)$$

In the control system as described above, the steady-state operating frequency of the RFPSE thermal amplifier driven alternator system is always equal to the frequency of the motor supply voltage $V'_{mo}$. The steady-state amplitude of the system variables at a given load is proportional to the motor voltage amplitude. Therefore, the steady-state load voltage can be held constant for all loading conditions by modulating the displacer drive motor supply voltage in the above discussed manner.

The system response for a step change in load from full load to 20% load under conditions where the load is purely resistive is illustrated in FIG. 9 of the drawings. In FIG. 9, the legends applied to the respective curves have the following meanings:

v=Load Voltage Amplitude
P=Piston Amplitude
D=Displacer Amplitude
M=Drive Motor Voltage Amplitude
C=Shunt Current Amplitude
F=Frequency The characteristic of the novel thermal amplifier system according to this invention can be summarized as follows:

1. All free vibration modes are damped under all loading conditions.
2. Alternator output voltage is proportional to the displacer drive supply voltage at a given load.
3. Steady state operating frequency is equal to the displacer drive motor supply voltage frequency.
4. Forced vibration RFPSE thermal amplifier output power at rated loads depends upon effective displacer rod area.

From the foregoing description, it will be appreciated that the invention provides a novel thermal amplifier system, method and control therefor, for controlling an externally excited forced vibration RFPSE thermal amplifier driven loads in a manner such that the RFPSE thermal amplifier driven system operates stably over the entire operating load range for which it is designed and maintains adequate stability for large changes in load conditions. The system provides steady-state regulation of operating frequency and load voltage over the design operating range while allowing transient response for large changes in load. Further, the system provides single push-button start-up/shut-down of the system by using the displacer drive motor to initially start the system once the thermodynamic inputs to the RFPSE thermal amplifier are put in place.

INDUSTRIAL APPLICABILITY

This invention relates to a novel thermal amplifier system and method for controlling a forced vibration resonant free piston Stirling engine thermal amplifier and control therefor. The system is intended for use as a primary power source for driving electric generators/alternators to produce electrical power for residential, commercial, industrial or military use and/or for directly driving apparatus such as compressors, pumps and the like.

Having described several embodiment of a novel thermal amplifier system and method for controlling and externally excited forced vibration resonant free piston Stirling engine thermal amplifier and control therefor according to the invention, it is believed obvious that other modifications and variations of the invention will be suggested to those skilled in the art in light of the above teachings. It is therefore to be understood that changes may be made in the particular embodiments of the invention described which are within the full intended scope of the invention as defined by the appended claims.

What is claimed is:

1. An externally excited resonant free piston Stirling engine thermal amplifier and load system driven thereby which is over damped at all operating load levels and does not freely oscillate comprising:

a variably controlled drive motor drivingly coupled with the displacer/piston of the engine;

controllable power supply means coupled to the drive motor to provide variably controlled energizing electric signals to the drive motor;

means for sensing at least one selected operating parameter of the Stirling engine thermal amplifier and load system during operation thereof to drive a load; and feedback means including means responsive to the sensed Stirling engine thermal amplifier system operating parameter signal for deriving at least one feedback control signal operative to control the energizing electric signals supplied to the drive motor for controlling its operation and thereby precisely, variably and stably control operation of the Stirling engine thermal amplifier and load system.

2. A system according to claim 1, wherein the means for sensing at least one selected operating parameter of the Stirling engine thermal amplifier and load system comprises means for sensing an operating parameter of the Stirling engine thermal amplifier and deriving a feedback signal in response thereto for variably controlling the drive motor to thereby precisely, variably and stably control operation of the Stirling engine thermal amplifier and load system.

3. A system according to claim 2, further including means for sensing at least one selected operating parameter of the load driven by the Stirling engine thermal amplifier and deriving a feedback signal representative thereof; and feedback means including means responsive to both the sensed Stirling engine thermal amplifier operating parameter feedback signal and the load operating parameter feedback signal for developing at least one feedback control signal operative to control the energizing electric signals supplied to the drive motor to thereby precisely, variably and stably control opration of the Stirling engine thermal amplifier and load system.

4. A system according to claim 2, wherein the means for sensing at least one selected operating parameter of the Stirling engine thermal amplifier comprises means for sensing the velocity of the working piston of the resonant free piston Stirling engine and deriving a piston velocity feedback signal and said feedback means comprises feedback motor voltage control means for deriving a feedback motor voltage control signal in response to said piston velocity feedback signal.

5. A system according to claim 3, wherein the means for sensing at least one selected operating parameter of the Stirling engine thermal amplifier comprises means for sensing the velocity of the working piston of the resonant free piston Stirling engine and deriving a piston velocity feedback signal and said feedback means comprises feedback motor voltage control means for deriving a feedback motor voltage control signal in response to said piston velocity feedback signal and to said load operating parameter feedback signal for use in controlling the drive motor to thereby precisely, variably and stably control operation of the Stirling engine thermal amplifier and load system.

6. A system according to claim 5, wherein the feedback motor voltage control means includes first voltage control feedback signal summing means for summing together the piston velocity feedback signal with a reference value piston velocity signal and deriving a piston velocity error signal and second voltage control feedback signal summing means for summing together the piston velocity error signal with the load operating parameter feedback signal and with a reference input motor voltage signal to derive the feedback motor voltage control signal for controlling the drive motor and thereby control operation of the Stirling engine thermal amplifier and load system.

7. A system according to claim 2, wherein said feedback means comprises at least two separate feedback paths for two different Stirling engine thermal amplifier operating parameter feedback signals and further includes displacer phase angle feedback control signal means comprising means for sensing the velocity of the displacer of the Stirling engine and for deriving a displacer velocity feedback signal, and first phase detector means responsive to the piston velocity feedback signal and to the displacer velocity feedback signal for deriving a displacer phase angle feedback signal for use in controlling frequency of operation of the drive motor in conjunction with the feedback voltage control signal to thereby control operation of the Stirling engine thermal amplifier and load system.

8. A system according to claim 7, wherein the displacer phase angle feedback control signal means comprises first phase angle feedback signal summing means for summing together the displacer phase angle feedback signal supplied from the output from the first phase detector means with a reference displacer phase angle signal to derive an phase angle error feedback signal and second phase angle feedback signal summing means for summing together the phase angle error feedback signal with a drive motor reference frequency signal and deriving a drive motor phase angle feedback frequency control signal for use in controlling frequency of operation of the drive motor in conjunction with the feedback motor voltage control signal to thereby control operation of the Stirling engine thermal amplifier and drive system.

9. A system according to claim 8, wherein the feedback motor voltage control means further includes piston velocity signal differentiating circuit means responsive to the piston velocity feedback signal for deriving a differentiated piston velocity feedback signal indicative of transient changes in piston velocity, said piston velocity differentiating circuit means having its output supplied to a second input of said second voltage control feedback signal summing means in parallel with said piston velocity error signal for use in deriving a feedback motor voltage control signal for controlling operation of the Stirling engine thermal amplifier and load system.

10. An externally excited resonant free piston Stirling engine thermal amplifier and load system according to claim 9, wherein the working piston is coupled to and drives an alternator for supplying an electrical load and wherein the means for sensing at least one selected operating parameter of the load driven by the Stirling engine thermal amplifier and deriving a feedback signal representative thereof comprises means for sensing the alternator output load voltage and deriving a load voltage feedback signal, third voltage control feedback signal summing means for summing together said load voltage feedback signal with a reference value load voltage signal and deriving a load voltage error signal, load voltage error signal integrating circuit means responsive to the load voltage error signal for integrating the load voltge error signal over a time period and supplying the integrated load voltage error signal to a third input of said second motor voltage control signal summing means in parallel with said piston velocity error signal and said differentiated piston velocity correction signal for summing together with said reference input motor voltage signal to derive the feedback motor voltage control signal for use in controlling the drive motor and hence operation of the Stirling engine thermal amplifier and load system.

11. A system according to claim 10, wherein the feedback motor voltage control means further includes proportional amplifier means connected in each of said piston velocity signal path, said differentiated piston velocity signal path and said integrated load voltage error signal path, respectively, in advance of said second voltage control feedback signal summing means, said proportional amplifier means each having respective proportional gain transfer characteristics for minimizing steady-state errors and settling time for system transients during operation of the Stirling engine thermal amplifier system.

12. A system according to claim 11, wherein said second voltage control signal summing means comprises a two part summing means for initially summing together in a first part of the second summing means said integrated load voltage error signal, said piston velocity error signal, and said differentiated piston velocity feedback signal to derive a feedback motor voltage correction signal that is summed with the reference input motor voltage signal in a second part of the second voltage control signal summing means to derive the feedback motor voltage control signal for controlling the drive motor and thereby control operation of the Stirling engine thermal amplifier system.

13. A system according to claim 12, wherein the feedback motor voltage control signal derived from the output of the second part of the second voltage control signal summing means is applied to control the output voltage of an electrical power converter circuit that supplies excitation electrical power to drive motor.

14. A system according to claim 8, wherein said displacer phase angle feedback control signal means further includes displacer phase angle signal differentiating circuit means responsive to the displacer phase angle feedback signal for deriving a differentiated displacer phase angle feedback signal indicative of transient changes in the displacer phase angle, said displacer phase angle signal differentiating circuit means having its output differentiated displacer phase angle feedback signal supplied to a second input of said second phase angle feedback control signal summing means in parallel with said displacer phase angle feedback signal for deriving the output displacer motor phase angle feedback frequency control signal.

15. A system according to claim 14, wherein said displacer phase angle feedback control signal means further includes means for sensing the phase and magnitude of the current flowing in the drive motor and for deriving a drive motor current feedback signal proportional thereto, second phase detector means responsive to said drive motor current feedback signal and to said displacer velocity feedback signal for phase comparing the two signals and deriving therefrom a feedback drive motor reactive current component signal, third phase angle feedback signal summing means for summing said feedback drive motor reactive current component signal, with a reference value drive motor reactive current signal and deriving a feedback drive motor reactive current error signal, drive motor reactive current error signal integrating circuit means responsive to the drive motor reactive current error signal for integrating the reactive current error signal over a time period and supplying the integrated drive motor reactive current error signal to a third input of said second phase angle feedback control signal summing means in parallel with said displacer phase angle feedback signal and said differentiated displacer phase angle feedback signal to derive the output drive motor phase angle feedback frequency control signal for use in controlling frequency of operation of the drive motor in conjunction with the feedback motor voltage control signal to thereby control operation of the Stirling engine thermal amplifier system.

16. A system according to claim 15, wherein the displacer phase angle feedback control signal means further includes proportional amplifier means connected in the feedback paths of each of said displacer phase angle feedback signal, said differentiated displacer phase angle feedback signal and said integrated reactive motor current error signal, respectively, in advance of said second phase angle feedback control signal summing means, said proportional amplifier means each having respective proportional gain transfer characteristics for minimizing steady-state errors and settling time for system transients during operation of the Stirling engine thermal amplifier system.

17. A system according to claim 16, wherein said second phase angle feedback control signal summing means comprises a two part summing means for initially summing together in a first part of said second summing means said displacer phase angle feedback signal, said differentiated displacer phase angle feedback signal and said integrated drive motor reactive current error signal to derive a feedback displacer phase angle correction signal that is summed with the reference frequency signal in a second part of the second phase angle feedback control signal summing means to derive the displacer motor phase angle feedback control signal for use in controlling frequency of operation of the drive motor in conjunction with the feedback motor voltage control signal.

18. A system according to claim 17, wherein the displacer motor phase angle feedback control signal derived from the output of the second part of the second phase angle feedback control signal summing circuit means is applied to control the frequency of operation of an electrical power converter circuit that supplies excitation electrical power to the drive motor.

19. A system according to claim 8, wherein the feedback motor voltage control means further includes piston velocity signal differentiating circuit means responsive to the piston velocity feedback signal for deriving a differentiated piston velocity feedback signal indicative of transient changes in piston velocity, said piston velocity differentiating circuit means having its output supplied to a second input of said second motor voltage control signal summing means in parallel with said piston velocity error signal for use in deriving a feedback motor voltage control signal for controlling the voltage of the excitation signals supplied to the drive motor and wherein said displacer phase angle feedback control signal means further includes displacer phase angle signal differentiating circuit means responsive to the displacer phase angle feedback signal for deriving a differentiated displacer phase angle feedback signal indicative of transient changes in displacer phase angle, said displacer phase angle signal differentiating circuit means having its output differentiated displacer phase angle feedback signal supplied to a second input of said second phase angle feedback control signal summing means in parallel with said displacer phase angle feedback signal for deriving the output displacer motor phase angle feedback frequency control signal.

20. An externally excited resonant free piston Stirling engine thermal amplifier and load system according to claim 19, wherein the working piston is coupled to and drives an alternator for supplying an electrical load and wherein the feedback motor voltage control means further includes means for sensing the alternator output load voltage and deriving a load voltage feedback signal, third motor voltage control signal summing means for summing together said load voltage feedback signal with a reference value load voltage signal and deriving a load voltage error signal, load voltage error signal integrating circuit means responsive to the load voltage error signal for integrating the load voltage error signal over a time period and supplying the integrated load voltage error signal to a third input of said second motor voltage control signal summing means in parallel with said piston velocity error signal and said differentiated piston velocity correction signal for summing together with said reference input motor voltage signal to derive the feedback motor voltage control signal for use in controlling the value of the excitation voltage supplied to the drive motor and hence the Stirling engine thermal amplifier system.

21. A system according to claim 20, wherein said displacer phase angle feedback control signal means further includes means for sensing the phase and magnitude of the motor current flowing in the drive motor and for deriving a motor current feedback signal proportional thereto, second phase detector means responsive to said motor current feedback signal and to said displacer velocity feedback signal for phase comparing the two signals and deriving therefrom a feedback drive motor reactive current component signal, third phase angle feedback signal summing means for summing said feedback drive motor reactive current component signal with a reference value drive motor reactive current signal and deriving a feedback drive motor reactive current error signal, drive motor reactive current error signal integrating circuit means responsive to the drive motor reactive current error signal for integrating the reactive current error signal over a time period and supplying the integrated drive motor reactive current error signal to a third input of said second alpha angle feedback control signal summing means in parallel with said displacer phase angle feedback signal and said differentiated displacer phase angle feedback signal to derive the output drive motor phase angle feedback frequency control signal for use in controlling frequency of operation of the drive motor in conjunction with the feedback motor voltage control signal to thereby control operation of the Stirling engine thermal amplifier system.

22. A system according to claim 21, wherein the feedback motor voltage control means further includes first proportional amplifier means connected in each of said piston velocity signal path, said differentiated piston velocity signal path and said integrated load voltage error signal path, respectively, in advance of said second summing means, said first proportional amplifier means each having respective proportional gain transfer characteristics for minimizing steady-state errors and settling time for system transients during operation of the Stirling engine thermal amplifier and wherein the displacer phase angle feedback control signal means further includes second proportional amplifier circuit means connected in each of said displacer phase angle feedback signal path, said differentiated displacer phase angle feedback signal path and said integrated drive motor reactive current error signal path, respectively, in advance of said second phase angle feedback control signal summing means, said second amplifier circuit means each having respective proportional gain transfer functions for minimizing steady-state errors and settling time for system transients during operation of the Stirling engine thermal amplifier system.

23. A system according to claim 22, wherein said second motor voltage control signal summing means comprises a two part summing means for initially summing together in a first part of the second summing means said integrated load voltage error signal, said piston velocity error signal, and said differentiated piston velocity feedback signal to derive a feedback motor voltage correction signal that is summed with the input reference motor voltage signal in a second part of the second motor voltage control signal summing means to derive the feedback motor voltage control signal for controlling the voltage of the excitation power supplied to the drive motor and wherein said second phase angle feedback control signal summing circuit means comprises a two part summing means for initially summing together in a first part of said second phase angle signal summing means said displacer phase angle feedback signal, said differentiated displacer phase angle feedback signal and said integrated drive motor reactive current error signal to derive a feedback displacer phase angle correciton signal that is summed with the input reference frequency signal in a second part of the second phase angle feedback control signal summing means to derive the the displacer motor phase angle feedback control signal for use in controlling frequency of operation of the drive motor in conjunction with the feedback motor voltage control signal.

24. A system according to claim 23, wherein the feedback motor voltage control signal derived from the output of the second part of the second motor voltage control signal summing means is applied to control the operation and output voltage of an electrical power converter circuit that supplies excitation electrical power to the drive motor and wherein the displacer motor phase angle feedback control signal derived from the output of the second part of the second phase angle feedback control signal summing means is applied to control the frequency of operation of the electrical power converter circuit that supplies excitation electrical power to the drive motor.

25. A system according to claim 10, further including additional frequency control means for regulating the output frequency of the alternator, said additional frequency control means comprising frequency sensing means for deriving a signal representative of the frequency of the alternator output, summing circuit means for summing together the alternator frequency signal with a reference frequency signal to derive alternator frequency error signal and means for applying the alternator frequency error signal to control the resonant frequency of operation of the RFPSE during operation thereof.

26. A system according to claim 24, further including additional frequency control means for regulating the output frequency of the alternator, said additional frequency control means comprising frequency sensing means for deriving a signal representative of the frequency of the alternator output, summing circuit means for summing together the alternator frequency signal with a reference frequency signal to derive alternator frequency error signal and means for applying the alternator frequency error signal to control the resonant frequency of operation of the RFPSE during operation thereof.

27. The method of controlling an externally excited resonant free piston Stirlng engine thermal amplifier which is over damped at all operating load levels and does not freely oscillate and which has a separate drive motor drivingly coupled to the displacer/piston mass of the Stirling engine and not coupled thereto as a load for selectively driving the displacer/piston mass to thereby control operation of the Stirling engine thermal amplifier; said method comprising sensing at least one selected operating parameter of the Stirling engine thermal amplifier and load system during operation thereof to drive a load, deriving at least one feedback control signal responsive to said sensed parameter, and feeding back said feedback control signal to control the energizing electric power supplied to the drive motor for controlling its operation and thereby control operation of the Stirling engine thermal amplifier and load system.

28. The method according to claim 27, wherein the selected operating parameter of the Stirling engine thermal amplifier system that is sensed is the working piston velocity and a piston velocity feedback signal is derived, and the method further comprises deriving a feedback motor voltage control signal from said piston velocity feedback signal for use in controlling the magnitude of the excitation voltage supplied to the drive motor during operation of the Stirling engine thermal amplifier system.

29. The method according to claim 28, wherein at least two different operating parameters of the Stirling engine thermal amplifier are sensed and used to control the operation thereof, and the method further comprises sensing the displacer velocity and deriving a displacer velocity feedback signal, deriving a displacer phase angle feedback signal from said piston velocity feedback signal and said displacer velocity feedback signal indicative of the phase difference between the displacer and working piston of the Stirling engine, deriving the feedback motor voltage control signal from said piston velocity feedback signal for use in controlling the magnitude of the excitation voltage supplied to said drive motor during operation of the Stirling engine thermal amplifier, and deriving a drive motor phase angle feedback frequency control signal from said displacer phase angle feedback signal for use in controlling the frequency of the excitation voltage supplied to the drive motor in conjunction with the feedback motor voltage control signal for controlling operation of the drive motor to thereby control the Stirling engine thermal amplifier system.

30. The method according to claim 29, further including differentiating said piston velocity feedback signal and deriving a differentiated piston velocity feedback signal, feeding back said differentiated piston velocity feedback signal in parallel with the piston velocity feedback signal to derive the feedback motor voltage control signal, differentiating the displacer phase angle feedback signal and feeding back said differentiated displacer phase angle feedback signal in parallel with the displacer phase angle feedback signal to derive the drive motor phase angle feedback frequency control signal.

31. The method of controlling an externally excited resonant free piston Stirling engine thermal amplifier according to claim 30, wherein the working piston of the Stirling engine is coupled to and drives an alternator for supplying an electrical load and wherein the method further includes sensing the alternator output load voltage and deriving a load voltage feedback signal, summing the load voltage feedback signal with a reference value load voltage signal and deriving a load voltage error signal, integrating the load voltage error signal, and summing the integrated load voltage error signal, the differentiated piston velocity feedback signal and the piston velocity feedback signal together with a reference input drive motor voltage signal to derive the output feedback motor voltage control signal for use in controlling the magnitude of the excitation voltage supplied to the drive motor during operation of the Stirling engine thermal amplifier system.

32. The method according to claim 31, further including sensing the phase and magnitude of the motor current flowing in the drive motor and deriving a motor current feedback signal proportional thereto, phase comparing the motor current feedback signal to the displacer velocity feedback signal and deriving a drive motor reactive current component signal, summing the drive motor reactive current component signal with an input reference drive motor reactive current signal to derive a drive motor reactive current error signal, integrating the drive motor reactive current error signal to derive a feedback integrated drive motor reactive current error signal, and summing the feedback integrated drive motor reactive current error signal, the differentiated displacer phase angle feedback signal and the displacer phase angle feedback signal together with an input drive motor reference frequency signal to derive the output drive motor phase angle feedback frequency control signal for use in controlling the frequency of the excitation voltage supplied to the drive motor during operation of the Stirling engine thermal amplifier.

33. The method according to claim 32, further including proportionally amplifying each of said piston velocity feedback signal, said differentiated piston velocity feedback signal and said integrated load voltage error signal, respectively, in advance of summing said signals together with the reference input drive motor voltage signal to derive the output feedback motor voltage control signal, and proportionally amplifying each of said feedback integrated drive motor reactive current error signal, the differentiated displacer phase angle feedback signal and the displacer phase angle feedback signal, respectively, in advance of summing said signals together with the input drive motor reference frequency signal to derive the output drive motor phase angle feedback frequency control signal, to reduce steady-state errors and settling time for system transients during operation of the Stirling engine thermal amplifier.

34. The method according to claim 31, further including deriving a frequency error signal from the output of the alternator and employing the frequency error signal to regulate the resonating frequency of operation of the resonant free piston Stirling engine thermal amplifier.

35. The method according to claim 33, further including deriving a frequency error signal from the output of the alternator and employing the frequency error signal to regulate the resonating frequency of operation of the resonant free piston Stirling engine thermal amplifier.

36. An externally excited resonant free piston Stirling engine thermal amplifier system which is over damped at all operating load levels and does not freely oscillate comprising:

a variably controlled drive motor drivingly coupled with the displacer/piston of the engine;

controllable power supply means connected with the drive motor to provide energizing electric signals to the drive motor;

means for sensing at least one selected operating parameter of the load driven by the Stirling engine thermal amplifier system and deriving a feedback signal representative thereof; and feedback means including means responsive to the sensed load operating parameter signal for developing at least one feedback control signal operative to control the energizing electric signals supplied to the drive motor for controlling its operation and thereby precisely, variably and stably control operation of the Stirling engine thermal amplifier system and the load driven thereby.

37. A control system for an externally excited resonant free piston Stirling engine thermal amplifier which is over damped at all load levels and does not freely oscillate and which has a separate controllable drive motor drivingly coupled with the displacer/piston of the engine; said system comprising variably controllable power supply means connectable with the drive motor to provide energizing electric signals thereto;

means for sensing at least one selected operating parameter of the Stirling engine thermal amplifier system and deriving a feedback signal representative thereof;

feedback means including means responsive to the operating parameter signal for developing at least one feedback control signal;

and means for applying said feedback control signal to the controllable power supply means for controlling the nature of the energizing electric signals supplied to the drive motor to thereby control operation of the Stirling engine thermal amplifier system.

38. A control system for an externally excited resonant free piston Stirling engine thermal amplifier which is over damped at all load levels and does not freely oscillate and which has a separate, controllable drive motor drivingly coupled with the displacer/piston of the engine; said control system comprising:

controllable power supply means connectable with the drive motor to provide energizing electric signals to the drive motor;

means for sensing at least one selected operating parameter of the Stirling engine thermal amplifier during operation thereof to drive a load and deriving a feedback signal representative thereof;

means for sensing at least one selected operating parameter of the load driven by the Stirling engine thermal amplifier and deriving a feedback signal representative thereof; and feedback means including means responsive to both the sensed Stirling engine thermal amplifier operating parameter feedback signal and the load operating parameter feedback signal for developing at least one feedback control signal operative to control the energizing electric signals supplied to the drive motor for controlling its operation to thereby control operation of the Stirling engine thermal amplifier and load system.

39. A control system according to claim 38, wherein the means for sensing at least one selected operating parameter of the Stirling engine thermal amplifier comprises means for sensing the velocity of the working piston of the resonant free piston Stirling engine and deriving a piston velocity feedback signal and said feedback means comprises feedback motor voltage control means for deriving a feedback motor voltage control signal in response to said piston velocity feedback signal and said load operating parameter feedback signal for use in controlling the drive motor to thereby control operation of the Stirling engine thermal amplifier system.

40. A control system according to claim 39, wherein said feedback means comprises at least two separate feedback paths for two different Stirling engine operating parameter feedback signals and further includes displacer phase angle feedback control signal means comprising means for sensing the velocity of the displacer of the Stirling engine and for deriving a displacer velocity feedback signal, and first phase detector means responsive to the piston velocity feedback signal and to the displacer velocity feedback signal for deriving a displacer phase angle feedback signal for use in controlling frequency of operation of the drive motor in conjunction with the feedback voltage control signal to thereby control the drive motor and operation of the Stirling engine thermal amplifier system.

41. A control system according to claim 40, wherein the feedback motor voltage control means further includes piston velocity signal differentiating circuit means responsive to the piston velocity feedback signal for deriving a differentiated piston velocity feedback signal indicative of transient changes in piston velocity, said piston velocity differentiating circuit means having its output supplied in parallel with said piston velocity signal for use in deriving a feedback motor voltage control signal for controlling operation of the drive motor and hence the Stirling engine thermal amplifier system.

42. A control system for an externally excited resonant free piston Stirling engine thermal amplifier according to claim 41, for use in a system wherein the working piston of the RFPSE is coupled to and drives an alternator for supplying an electrical load and wherein the means for sensing at least one selected operating parameter of the load driven by the Stirling engine thermal amplifier and deriving a feedback signal representative thereof comprises means for sensing the alternator output load voltage and deriving a load voltage feedback signal; said control system further comprising third voltage control feedback signal summing means for summing together the load voltage feedback signal with a reference value load voltage signal and deriving a load voltage error signal, load voltage error signal integrating circuit means responsive to the load voltage error signal for integrating the load voltage error signal over a time period and supplying the integrated load voltage error signal to an input of motor voltage control signal summing means in parallel with said piston velocity error signal and said differentiated piston velocity correction signal for summing together with said reference input motor voltage signal to derive the feedback motor voltage control signal for use in controlling the drive motor and hence operation of the Stirling engine thermal amplifier system.

43. A control system according to claim 42, wherein the feedback motor voltage control means further includes proportional amplifier circuit means connected in each of said piston velocity signal path, said differeniated piston velocity signal path and said integrated load voltage error signal path, respectively, in advance of the voltage control feedback signal summing means, said proportional amplifier circuit means each having respective proportional gain transfer characteristics for minimizing steady-state errors and settling time for system transients during operation of the Stirling engine thermal amplifier system.

44. A control system according to claim 40, wherein the displacer phase angle feedback control signal means comprises first phase angle feedback signal summing means for summing together the displacer phase angle feedback signal supplied from the output from the phase detector means with a reference displacer phase angle signal to derive an phase angle error feedback signal and second phase angle feedback control signal summing means for summing together the phase angle error feedback signal with a motor reference frequency signal and deriving an output displacer motor phase angle feedback frequency control signal for use in controlling frequency of operation of the drive motor in conjunction with the feedback motor voltage control signal to thereby control operation of the Stirling engine thermal amplifier system.

45. A control system according to claim 44, wherein said displacer phase angle feedback control signal means further includes displacer phase angle signal differentiating circuit means responsive to the displacer phase angle feedback signal for deriving a differentiated displacer phase angle feedback signal indicative of transient changes in the displacer phase angle, said displacer phase angle signal differentiating circuit means having its output differentiated displacer phase angle feedback signal supplied to an phase angle feedback control signal summing means in parallel with said displacer phase angle feedback signal for deriving the output displacer motor phase angle feedback frequency control signal system.

46. A control system according to claim 45, wherein said displacer phase angle feedback control signal means further includes means for sensing the phase and magnitude of the current flowing in the drive motor and for deriving a drive motor current feedback signal proportional thereto, second phase detector means responsive to said drive motor current feedback signal and to said displacer velocity feedback signal for phase comparing the two signals and deriving therefrom a feedback drive motor reactive current component signal, summing means for summing said feedback drive motor reactive current component signal with a reference value drive motor reactive current signal and deriving a feedback drive motor reactive current error signal, drive motor reactive current error signal integrating circuit means responsive to the drive motor reactive current error signal for integrating the reactive current error signal over a time period and supplying the integrated drive motor reactive current error signal to a summing means in parallel with said displacer phase angle feedback signal and said differentiated displacer phase angle feedback signal to derive the output drive motor phase angle feedback frequency control signal for use in controlling frequency of operation of the drive motor in conjunction with the feedback motor voltage control signal to thereby control operation of the Stirling engine thermal amplifier system.

47. A control system according to claim 40, wherein the feedback motor voltage control means further includes piston velocity signal differentiating circuit means responsive to the piston velocity feedback signal for deriving a differentiated piston velocity feedback signal indicative of transient changes in piston velocity, said piston velocity differentiating circuit means having its output supplied to a signal summing means in parallel with said piston velocity error signal for use in deriving a feedback motor voltage control signal for controlling the voltage of the excitation signals supplied to the drive motor and wherein said displacer phase angle feedback control signal means further includes displacer phase angle signal differentiating circuit means responsive to the displacer phase angle feedback signal for deriving a differentiated displacer phase angle feedback signal indicative of transient changes in displacer phase angle, said displacer phase angle signal differentiating circuit means having its output differentiated displacer phase angle feedback signal supplied to a signal summing means in parallel with said displacer phase angle feedback signal for deriving the output displacer motor phase angle feedback frequency control signal.

48. A control system for a forced vibration resonant free piston Stirling engine thermal amplifier according to claim 47, wherein the working piston is adapted to be coupled to and drive an alternator for supplying an electrical load and wherein the feedback motor voltage control means further includes means for sensing the alternator output load voltage and deriving a load voltage feedback signal; said control system further including signal summing means for summing together said load voltage feedback signal with a reference value load voltage signal and deriving a load voltage error signal, load voltage error signal integrating circuit means responsive to the load voltage error signal for integrating the load voltage error signal over a time period and supplying the integrated load voltage error signal to a third input of said second motor voltage control signal summing means in parallel with said piston velocity error signal and said differentiated piston velocity correction signal for summing together with said reference input motor voltage signal to derive the feedback motor voltage control signal for use in controlling the value of the excitation voltage supplied to the drive motor and hence the Stirling engine thermal amplifier system.

49. A control system according to claim 48, wherein said displacer phase angle feedback control signal means further includes means for sensing the phase and magnitude of the motor current flowing in the drive motor and for deriving a motor current feedback signal proportional thereto, second phase detector means responsive to said motor current feedback signal and to said displacer velocity feedback signal for phase comparing the two signals and deriving therefrom a feedback drive motor reactive current component signal, summing means for summing said feedback drive motor reactive current component signal with a reference value drive motor reactive current signal and deriving a feedback drive motor reactive current error signal, drive motor reactive current error signal integrating circuit means responsive to the drive motor reactive current error signal for integrating the reactive current error signal over a time period and supplying the integrated drive motor reactive current error signal to a signal summing means in parallel with said displacer phase angle feedback signal and said differentiated displacer phase angle feedback signal to derive the output drive motor phase angle feedback frequency control signal for use in controlling frequency of operation of the drive motor in conjunction with the feedback motor voltage control signal to thereby control operation of the Stirling engine thermal amplifier system.

50. A control system according to claim 49, wherein the feedback motor voltage control means further includes first amplifier circuit means connected to each of said piston velocity signal path, said differentiated piston velocity signal path and said integrated load voltage error signal paths, respectively, in advance of said second summing means, said first amplifier circuit means each having respective proportional gain transfer characteristics for minimizing steady-state errors and settling time for system transients during operation of the Stirling engine thermal amplifier and wherein the displacer alpha angle feedback control signal means further includes second amplifier circuit means connected in the feedback paths of each of said displacer phase angle feedback signal, said differentiated displacer phase angle feedback signal and said integrated drive motor reactive current error signal path, respectively, in advance of said second phase angle feedback control signal summing means, said second amplifier circuit means each having respective proportional gain transfer functions for minimizing steady-state errors and settling time for system transients during operation of the Stirling engine thermal amplifier system.

51. A control system according to claim 42, further including additional frequency control means for regulating the output frequency of the alternator, said additional frequency control means comprising frequency sensing means for deriving a signal representative of the frequency of the alternator output, summing circuit means for summing together the alternator frequency signal with a reference signal to derive an alternator frequency error signal and means for applying the alternator frequency error signal to control the resonant frequency of operation of the RFPSE during operation thereof.

52. A control system according to claim 50, further including additional frequency control means for regulating the output frequency of the alternator, said additional frequency control means comprising frequency sensing means for deriving a signal representative of the frequency of the alternator output, summing circuit means for summing together the alternator frequency signal with a reference signal to derive an alternator frequency error signal and means for applying the alternator frequency error signal to control the resonant frequency of operation of the RFPSE during operation thereof.

* * * * *